US006002901A

United States Patent [19]

Hoshizaki et al.

[11] Patent Number: 6,002,901

[45] Date of Patent: Dec. 14, 1999

[54] ELECTROPHOTOGRAPHIC PHOTORECEPTOR AND ELECTROPHOTOGRAPHIC APPARATUS

[75] Inventors: Taketoshi Hoshizaki; Yashuhiro Yamaguchi; Yasuo Sakaguchi; Ryosaku Igarashi, all of Minami Arhigara, Japan

[73] Assignee: Fuji Xerox Co., Ltd., Tokyo, Japan

[21] Appl. No.: 09/110,029

[22] Filed: Jul. 2, 1998

Related U.S. Application Data

[62] Division of application No. 08/681,370, Jul. 23, 1996, Pat. No. 5,834,146.

[30] Foreign Application Priority Data

Jul. 25, 1995 [JP] Japan ..... 7-208552
Jun. 7, 1996 [JP] Japan ..... 8-145472

[51] Int. Cl.[6] ..... G03G 15/04

[52] U.S. Cl. ..... 399/159

[58] Field of Search ..... 430/58, 59, 58.05, 430/58.7; 399/159

[56] References Cited

U.S. PATENT DOCUMENTS

| | | |
|---|---|---|
| 3,994,994 | 11/1976 | Stolka . |
| 4,618,551 | 10/1986 | Stolka et al. . |
| 4,806,443 | 2/1989 | Yanus et al. . |
| 4,818,650 | 4/1989 | Limburg et al. . |
| 4,923,775 | 5/1990 | Schank . |
| 4,935,487 | 6/1990 | Yanus et al. . |
| 4,956,440 | 9/1990 | Limburg et al. . |
| 5,306,586 | 4/1994 | Pai et al. . |
| 5,436,099 | 7/1995 | Schank et al. . |
| 5,456,989 | 10/1995 | Nogami et al. . |
| 5,591,554 | 1/1997 | Mishra et al. . |

FOREIGN PATENT DOCUMENTS

| | | |
|---|---|---|
| 1-169454 | 7/1989 | Japan . |
| 2-207258 | 8/1990 | Japan . |
| 3-31847 | 2/1991 | Japan . |
| 5-232727 | 9/1993 | Japan . |
| 5-313387 | 11/1993 | Japan . |
| 6-83077 | 3/1994 | Japan . |

OTHER PUBLICATIONS

R.M. Schaffert, *Focal Press*, "Electrophotography," (1975), pp. 342–345.

W.F. Berg et al., *Walter de Gruyter*, "Current Problems in Electrophotography," (1972), pp. 287–300.

N.C. Khe et al., *Journal of Japan Society of Chemistry*, "The Use of Magnesium Phthalocyanine Compounds as Electrophotographic Receptor Avaliable for Laser Diode Recording," (1986), pp. 393–401.

Kawamura, *Corona Publishing Co., Ltd.*, "Electrophotography Bases and Application, "(1988), pp.424–427.

Takashi's Kitamura et al., Journal of Society of Electrophotography "Studies on Metal–free Phthalocyanine–Polymer Photoreceptor doping with Electron Acceptor Molecule (I) Sensitization by electron acceptor doping," (1981), vol. 20, pp. 60–66.

*Primary Examiner*—Christopher D. Rodee
*Attorney, Agent, or Firm*—Oliff & Berridge, PLC

[57] ABSTRACT

An electrophotographic photoreceptor comprising an electrically conductive substrate having thereon a charge-generating layer and a charge-transporting layer, wherein the charge-transporting layer comprises: a nonuniform charge-transporting layer comprising an electrically inactive matrix and a charge-transporting domain dispersed in the matrix; and the uniform charge-transporting layer comprising a charge-transporting matrix.

22 Claims, 4 Drawing Sheets

ELECTROPHOTOGRAPHIC PHOTORECEPTOR AND ELECTROPHOTOGRAPHIC APPARATUS

This is a Division of application Ser. No. 08/681,370 now U.S. Pat. No. 5,834,148 filed Jul. 23, 1996. The entire disclosure of the prior application(s) is hereby incorporated by reference herein in its entirely.

FIELD OF THE INVENTION

The present invention relates to an electrophotographic photoreceptor comprising an electrically conductive substrate, a charge-generating layer and a charge-transporting layer. More particularly, the present invention relates to an electrophotographic photoreceptor suitable for digital electrophotography. The present invention further relates to a digital electrophotographic apparatus employing the electrophotographic photoreceptor.

BACKGROUND OF THE INVENTION

In recent years, electrophotography has played a major role in the field of copying machines, printers, facsimiles, etc. because it advantageously provides a high printing speed and a high print quality.

Electrophotographic photoreceptors comprising an inorganic photoconductive material such as selenium, selenium-tellurium alloy and selenium-arsenic alloy are widely known as the electrophotographic photoreceptor for use in electrophotography. On the other hand, extensive studies have been made on electrophotographic photoreceptors comprising an organic photoconductive material which is advantageous in cost, productivity and disposability as compared to these inorganic photoreceptors. Up to the present, these organic electrophotographic photoreceptors have surpassed the inorganic photoreceptors. In particular, an electrophotographic photoreceptor having a function-separation type laminated structure in which the photo-induced generation of electric charge and the transportation of electric charge, which are elementary processes in the photoconduction, are carried out by separate layers have been developed. This type of an electrophotographic photoreceptor provides an increased degree of freedom in selecting materials to thereby exhibit a remarkable enhancement of properties. At present, this function-separation type laminated organic photoreceptor becomes the main current. A film obtained by vacuum-evaporating a pigment having charge-generating ability such as quinone pigments, perylene pigments, azo pigments, phthalocyanine pigments and selenium, or by dispersing the above described pigment into a binder resin in a high concentration, is practically used as the charge-generating layer in the function-separation type laminated organic photoreceptor. On the other hand, a layer comprising an insulating resin and a low molecular weight compound having charge-transporting ability such as hydrazone compounds, benzidine compounds, amine compounds and stilbene compounds molecularly dispersed therein is used as the charge-transporting layer.

A photoreceptor to be mounted on an analog electrophotographic copying machine which operates by optically forming an image of the original onto the photoreceptor followed by exposure of the image is required to have photo-induced potential decay characteristics shown in FIG. 1, that is, to undergo potential decay in proportion to exposure amount (Hereinafter, a photoreceptor of this type is referred to as a "J-character type photoreceptor") so as to provide a good reproduction of half tone in the density gradation. All of the above described inorganic photoreceptors and function-separation type laminated organic photoreceptors exhibit photo-induced potential decay characteristics falling within this category. On the other hand, digital electrophotographic apparatuses which have been extensively studied with the recent requirement for higher image quality, higher value added and development of network generally employ an area gradation system which provides gradation by percent area such as dot. Therefore, the digital electrophotographic apparatus preferably employs a photoreceptor having so-called S-character type photo-induced potential decay characteristics (hereinafter referred to as "S-character type photoreceptor") in which potential shows no decay until a predetermined exposure amount is reached but shows a rapid decay when exposure amount exceeds the predetermined value for enhancing pixel sharpness.

The S-character type photo-induced potential decay characteristics are known phenomena with a single-layer photoreceptor comprising an inorganic pigment such as ZnO or an organic pigment such as phthalocyanine dispersed in a resin as disclosed in R. M. Schaffert, "Electrophotography", Focal Press, page 344, 1975; and J. W. Weigl, J. Mammino, G. L. Whittaker, R. W. Radler, J. F. Byrne, "Current Problems in Electrophotography", Walter de Gruyter, page 287, 1972. In particular, many single-layer photoreceptors for laser exposure have been proposed which comprises a resin and a phthalocyanine pigment dispersed therein and is sensitive to near infrared range, which is the emission wavelength of semiconductor lasers which are often used (as disclosed, for example, in Guen Chan K., Aizawa, "Journal of Japan Society of Chemistry", page 393, 1986; JP-A-1-169454 (The term "JP-A" as used herein means an "unexamined published Japanese patent application"), JP-A-2-207258, JP-A-3-31847, and JP-A-5-313387). However, such a single-layer photoreceptor needs to necessitate a single material fulfill both the two functions, i.e., generation of electric charge and transportation of electric charge. Nevertheless, materials which can fulfill both the two functions are rare, and such materials which can be practically used have never been obtained. In particular, a particulate pigment generally has many trap levels and thus is disadvantageous in that it has a low charge-transporting ability or tends to keep residual charge therein. Thus, such a particulate pigment is not suitable for transportation of electric charge. Only one exceptional practical example is a single-layer photoreceptor comprising a resin and ZnO dispersed therein. This type of a single-layer photoreceptor makes the best use of the hydrophilicity of ZnO to find a good application to a master plate for offset printing process which comprises plate-making by an area gradation process in which an image is formed in accordance with the presence or absence of adhesion of a hydrophobic toner (as disclosed in Kawamura, "Base and Application of Electrophotography", Society of Electrophotography, Corona, page 424, 1988). However, the success of this type of a single-layer photoreceptor was achieved only because it is applied to a master plate in which requirements for high printing speed and press life are not so high. Thus, this type of a single-layer photoreceptor cannot be practically used as a photoreceptor for copying machines and printers, which is the technical field of the present invention. In view of the above, it is desired to introduce the function-separation type laminated structure into the S-character type photoreceptor to enhance the degree of freedom in selecting materials and hence to enhance the comprehensive properties of the photoreceptor.

In respect to this problem, D. M. Pai et al. reported that a laminated photoreceptor consisting of a charge-generating layer and a charge-transporting layer wherein the charge-transporting layer is a nonuniform charge-transporting layer comprising at least two charge-transporting regions and at least one electrically inactive region, the charge-transporting regions coming into mutual contact to form a contorted charge-transporting passage, can realize S-character photo-induced potential decay characteristics when combined with an arbitrary charge-generating layer (as disclosed in JP-A-6-83077 (U.S. Pat. No. 5,306,586)). However, even this type of a photoreceptor must necessitate the charge-transporting layer fulfill the function of exhibiting S-character type photo-induced potential decay characteristics and the function of transporting electric charge. As compared to the charge-transporting layer in the conventional laminated photo-induced photoreceptor having J-character type photo-induced potential decay characteristics, the charge-transporting layer in this type of a laminated photoreceptor must be imparted the additional function of exhibiting S-character photo-induced potential decay characteristics. Thus, this type of a laminated photoreceptor is still subjected to a restriction in degree of freedom with respect to the design of the charge-transporting layer. The present invention is to solve the above described problems.

SUMMARY OF THE INVENTION

It is therefore an object of the present invention to provide a novel S-character type photoreceptor constitution which can overcome the above described difficulties.

It is another object of the present invention to provide an S-character photoreceptor having a high performance and being permitted a high degree of freedom in the selection of materials by introducing a concept of function separation into an electrophotographic photoreceptor comprising at least an electrically conductive substrate, a charge-generating layer and a charge-transporting layer.

It is a further object of the present invention to provide a digital electrophotographic apparatus utilizing a high performance S-character photoreceptor.

"Trap theory" by Kitamura and Kokado, "Journal of Society of Electrophotography", Vol. 20, page 60, 1982, and "contorted electrical conduction theory" by D. M. Pai in the above described patent have been proposed as a theory accounting for the emergent mechanism of S-character photo-induced potential decay characteristics. However, no theories have been established. Nevertheless, the above described single-layer photoreceptor having a pigment dispersed in a resin and the laminated photoreceptor comprising a nonuniform charge-transporting layer proposed by D. M. Pai, which have so far been reported as S-character type photoreceptors, can be recognized to have a common configuration that charge-transporting domains are dispersed in an electrically inactive matrix to form a charge-transporting passage having a nonuniform structure and that the nonuniform structure of the charge-transporting passage extends over the whole layer which is responsible for the transportation of electric charge.

The present inventors made extensive studies of S-character type photoreceptors, resulting in some findings, though their detailed mechanism is not necessarily clarified. That is, a photoreceptor of two-layer structure comprising an electrically conductive substrate having thereon: a charge-transporting layer used in the conventional J-character type function-separation laminated photoreceptor; and a pigment-dispersed resin layer, which layer is known as used in S-character type photoreceptor and has a charge generating function and a charge transporting function at the same time, exhibits S-character type photo-induced potential decay characteristics. Starting from this discovery, an idea was established that the key to the realization of S-character type photo-induced potential decay characteristics is the presence of a charge-transporting passage having a nonuniform structure in the initial stage of charge transportation, and that a nonuniform structure extending over the whole charge-transporting passage, which is common to the conventional S-character type photoreceptors, is not necessarily required. On the basis of this idea, it was found that the S-character type photoreceptor can be designed to have further function separated constitution by further developing the study made by D. M. Pai et al. Thus, the present invention has been achieved.

Therefore, the above described objects of the present invention can be achieved by forming a charge-transporting layer so as to have a constitution which comprises a nonuniform charge-transporting layer comprising an electrically inactive matrix and a charge-transporting domain dispersed therein and a uniform charge-transporting layer comprising a charge-transporting matrix.

That is, the present invention relates to an electrophotographic photoreceptor comprising an electrically conductive support having thereon a charge-generating layer and a charge-transporting layer, wherein the charge-transporting layer comprises: a nonuniform charge-transporting layer comprising an electrically inactive matrix and a charge-transporting domain dispersed in the matrix; and a uniform charge-transporting layer comprising a charge-transporting matrix.

The present invention is also relates to an electrophotographic apparatus, comprising:

(a) an electrophotographic photoreceptor comprising an electrically conductive substrate having thereon a charge-generating layer and a charge-transporting layer wherein the charge-transporting layer comprises: a nonuniform charge-transporting layer comprising an electrically inactive matrix and a charge-transporting domain dispersed in the matrix; and a uniform charge-transporting layer comprising a charge-transporting matrix;

(b) exposing means for exposing the electrophotographic photoreceptor in accordance with a digitized image signal.

The term "electrically inactive" as used herein means an actual electrical insulation state with respect to main charge such that the energy level for transporting main charge in a material having this property is so widely different from that in the charge-transporting domain, and main charge can substantially not be injected therein an ordinary electric field. The term "main charge" as used herein means positive charge if a positive charging process is used and means negative charge if a negative charging process is used, when the charge-generating layer is disposed closer to the surface of the photoreceptor than the charge-transporting layer. On the contrary, when the charge-transporting layer is disposed closer to the surface of the photoreceptor than the charge-generating layer, the term "main charge" means negative charge if a positive charging process is used and means positive charge if a negative charging process is used.

The $E_{50\%}/E_{10\%}$ ratio wherein $E_{50\%}$ represents exposure amount required for 50% charged potential decay and $E_{10\%}$ represents exposure amount required for 10% charged potential decay can be used as a measure of the S-characteristic of the photo-induced potential decay curve. When an ideal J-character type photoreceptor shows a potential decay in proportion to exposure amount, the $E_{50\%}/E_{10\%}$ value thereof is 5. An ordinary J-character type photoreceptor shows a drop of charge-generating efficiency and/or electric charge-transporting ability with the drop of electrical field intensity and thus exhibits an $E_{50\%}/E_{10\%}$ value of more than 5. On the other hand, a stepwise photo-induced potential decay curve which shows no potential decay until a certain exposure amount is reached but then shows a rapid potential decay to a residual potential level above the certain exposure amount, which is the extreme case of S-character type, gives an $E_{50\%}/E_{10\%}$ value of 1. Accordingly, the S-character type photo-induced potential decay characteristics are defined as having an $E_{50\%}/E_{10\%}$ of from 1 to 5. In the present invention, the photoreceptor preferably exhibit an $E_{50\%}/E_{10\%}$ value of from 1 to 5. In order to attain more desirable digital characteristics, the $E_{50\%}/E_{10\%}$ value is more preferably less than 3, and particularly preferably less than 2.

The reason why the above described electrophotographic photoreceptor can exhibit S-character photo-induced potential decay characteristics is not necessarily clarified. It is thought that the S-character potential decay is attributed to a nonuniform structure taking part in the transportation of electric charge which is present in the course of charge transportation, particularly in the initial stage of charge transportation. According to the above described patent to D. M. Pai et al., the mechanism of S-character type photo-induced potential decay is presumed as follows. In some detail, in the nonuniform charge-transporting layer, the charge-transporting domains dispersed in the electrically inactive matrix come into contact with each other to form a contorted charge-transporting passage. In this arrangement, when the electrophotographic photoreceptor is charged to be applied a high electric field across the photosensitive layer, electric charge generated in the charge-generating layer upon exposure migrates along the electric field direction and is injected into the charge-transporting layer under the influence of Coulomb force. The electric charge then migrates through the charge-transporting domain in the direction perpendicular to the surface of the electrophotographic photoreceptor. When the electric charge meets the barrier of the electrically inactive matrix, it temporarily stops migrating. If the migration length of the electric charge during the above period is sufficiently short as compared to the total thickness of the photosensitive layer comprising the charge-generating layer and the charge-transporting layer, the potential decay during the above period can be neglected. After electric charge equivalent to almost all surface electric charge is injected, the local electric field perpendicular to the photoreceptor surface in the vicinity of the electric charge becomes negligibly small. Thus, the electric charge which has temporarily stopped can free itself from restraint by the electric field and migrate in a direction not perpendicular to the photoreceptor surface. The electric charge then passes along a contortedly connected passage and reaches a deeper position than the position where it had stopped for the first time. At the deeper position, the electric charge is again subjected to a sufficiently high electric field similarly to the initial stage. The electric charge then stops migrating again when it meets the barrier of the electrically inactive matrix. However, since the electric field intensity has been reduced due to the previous charge migration, more electric charge passes through the contorted charge-transporting passage until it reaches the next insulating barrier. Thus, cascade-like migration of charge occurs, causing S-character photo-induced potential decay. This is a theory given by D. M. Pai et al.

However, once the migration of almost all electric charge is stopped by the barrier of the electrically inactive matrix and the cascade-like migration of electric charge is then begun, the subsequent barrier is no more required, rather it is thought preferable that a uniform charge-transporting passage is secured for the smooth migration of electric charge.

The present invention has been achieved on the basis of this idea. In other words, an S-character type photo-induced potential decay curve is realized by a nonuniform charge-transporting layer comprising an electrically inactive matrix and a charge-transporting domain dispersed therein, and the function of main charge-transporting is carried out by a uniform charge-transporting layer comprising a charge-transporting matrix, to thereby accomplish function separation. This gives a remarkably enhanced degree of freedom in designing the photoreceptor. The nonuniform charge-transporting layer comprising an electrically inactive matrix and a charge-transporting domain dispersed therein is hereinafter referred to as "nonuniform charge-transporting layer" or "S-character type charge-transporting layer". The uniform charge-transporting layer comprising a charge-transporting matrix is hereinafter referred to as "uniform charge-transporting layer".

The electrophotographic photoreceptor according to the present invention has a structure in which a nonuniform charge-transporting layer for providing S-characteristic is only added to a J-character type function-separation laminated photoreceptor, which has heretofore been extensively studied. Therefore, materials, compositions, and preparation methods for use in a charge-generating layer and a charge-transporting layer of the J-character type function-separation laminated photoreceptor, which have been known with many examples, can be arbitrarily selected and employed for the charge-generating layer and the charge-transporting layer of the present invention. This is very favorable for enhancing efficiency in the development of S-character type photoreceptors and for improving the properties thereof, and is one of excellent advantages of the present invention.

Further, in the electrophotographic photoreceptors containing a charge-transporting passage having a nonuniform structure extending over the whole charge-transporting layer which have heretofore been proposed as an S-character type photoreceptor, it is presumed that high charge-transporting ability is hard to attain because of the nonuniformity in the structure of the charge-transporting passage extending over the whole charge-transporting layer. On the contrary, in the present invention, the nonuniformity in the structure of the charge-transporting passage extends over only a part of the charge-transporting passage. Further, materials for use in the present invention can be selected from a large variety of materials. Accordingly, high charge-transporting ability can be attained more easily.

The above and other objects and features of the present invention will be more apparent from the following description taken in conjunction with the accompanying drawing.

DETAILED DESCRIPTION OF THE INVENTION

The various layers constituting the electrophotographic photoreceptor of the present invention are described in detail below.

Figure 3:
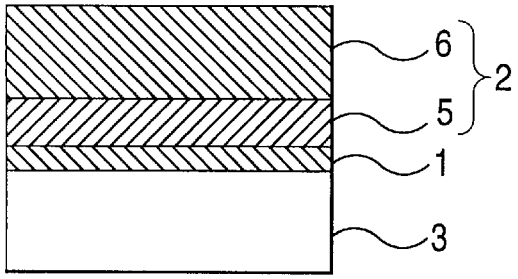
FIG. 3 is a typical sectional view illustrating an embodiment of the electrophotographic photoreceptor according to the present invention.
Figure 4:
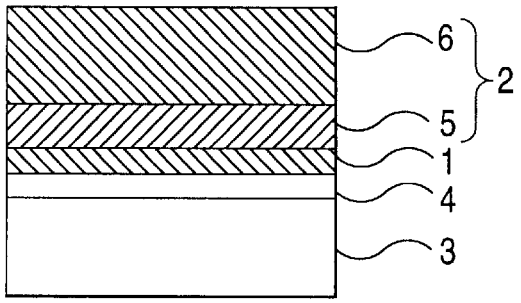
FIG. 4 is a typical sectional view illustrating another embodiment of the electrophotographic photoreceptor according to the present invention.
Figure 5:
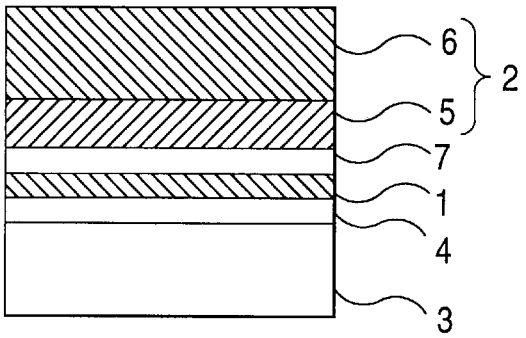
FIG. 5 is a typical sectional view illustrating a further embodiment of the electrophotographic photoreceptor according to the present invention.

FIGS. 3 to 5 illustrate a typical diagram showing a section of the electrophotographic photoreceptor according to the present invention. In FIG. 3, a charge-generating layer 1, which acts to generate electric charge upon irradiation with light, is provided on an electrically conductive substrate 3. On the charge-generating layer 1, a nonuniform charge-transporting layer 5 for providing S-characteristic is provided. Further, on the nonuniform charge-transporting layer 5, a uniform charge-transporting layer 6 which acts to transport electric charge smoothly is provided. In this arrangement, a charge-transporting layer 2 is formed. In FIG. 4, an undercoat layer 4 is provided between the electrically conductive substrate 3 and the charge-generating layer 1. In FIG. 5, an interlayer is provided between the charge-generating layer 1 and the nonuniform charge-transporting layer 5.

Figure 6:
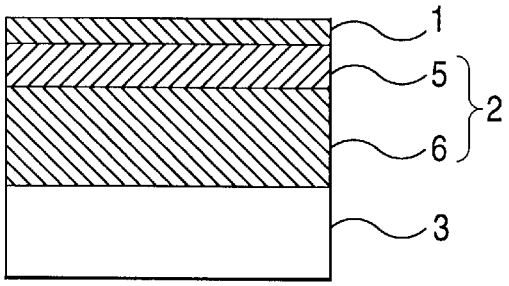
FIG. 6 is a typical sectional view illustrating a still further embodiment of the electrophotographic photoreceptor according to the present invention.
Figure 7:
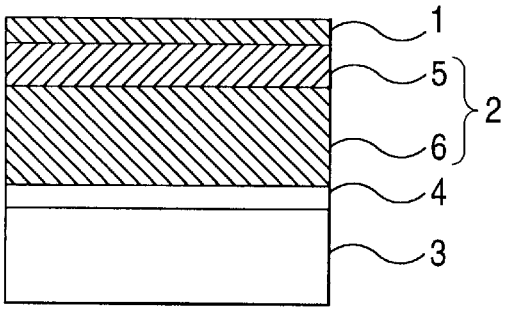
FIG. 7 is a typical sectional view illustrating a further embodiment of the electrophotographic photoreceptor according to the present invention.
Figure 8:
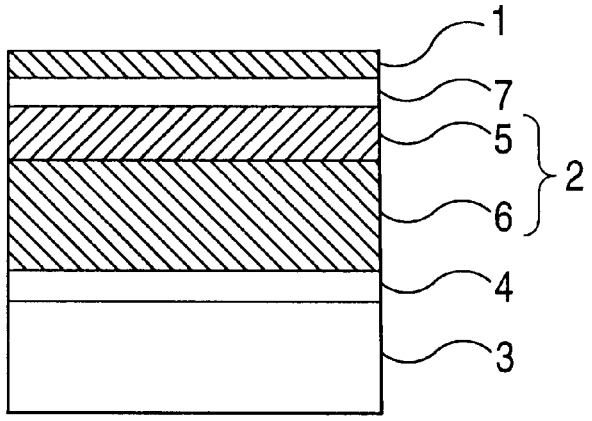
FIG. 8 is a typical sectional view illustrating a further embodiment of the electrophotographic photoreceptor according to the present invention.

FIGS. 6 to 8 illustrate a typical diagram showing a section of other embodiments of the electrophotographic photoreceptor according to the present invention. In FIG. 6, a uniform charge-transporting layer 6 is provided on the electrically conductive substrate 3. On the uniform charge-transporting layer 6, a nonuniform charge-transporting layer 5 is provided. Further, on the nonuniform charge-transporting layer 5, a charge-generating layer 1 is provided. In FIG. 7, an undercoat layer 4 is provided between the electrically conductive substrate 3 and the uniform charge-transporting layer 6. In FIG. 8, an interlayer 7 is provided between the charge-generating layer 1 and the nonuniform charge-transporting layer 5.

These electrophotographic photoreceptors may optionally further comprise a protective layer and/or irregular reflection layer.

As mentioned above, if the migration length during a period from when electric charge generated in the charge-generating layer migrates to when the electric charge temporarily stops for the first time by encountering hindrance of the electrically inactive matrix in the nonuniform charge-generating layer is sufficiently short with respect to the total thickness of the photosensitive layer, the potential decay during this period can be neglected, to thereby provide an even ideal S-character type photoreceptor. That is, the closer the charge-generating layer and the nonuniform charge-transporting layer for providing S-characteristic are provided to each other, the better is the resulting S-characteristic. However, for facilitating the injection or generation of electric charge or like purposes, an interlayer may be provided between the charge-generating layer and the nonuniform charge-transporting layer. When imperfect S-characteristic is desired, the uniform charge-transporting layer may be provided between the charge-generating layer and the nonuniform charge-transporting layer.

In the case of an electrophotographic photoreceptor having a structure shown in FIGS. 3 to 5 where the charge-generating layer is provided closer to the electrically conductive substrate than the other layers constituting the photosensitive layer, further improvements can be provided because the uniform charge-transporting layer is provided as the outermost layer. The surface layers must retain electric charge during charging and exhibit resistance to discharge products such as ozone and NOx produced by the charging member and resistance to abrasion by paper, cleaning member or the like, in addition to providing a photoelectric function. In the single-layer photoreceptor, the single photosensitive layer itself must satisfy these requirements in addition to the charge-generating function, charge-transporting function and the function of providing S-characteristic. In the laminated type photoreceptor consisting of a charge-generating layer and a nonuniform charge-transporting layer proposed by D. M. Pai et al., the nonuniform charge-transporting layer must satisfy the above described requirements in addition to the function of transporting electric charge and providing S-characteristic. It is more difficult to fulfill these functions at the same time. On the contrary, in the electrophotographic photoreceptor of the present invention having a structure shown in FIGS. 3 to 5, the generation of electric charge is carried out by the charge-generating layer and the realization of S-characteristic is carried out by the S-character type charge-transporting layer provided inside part of the photosensitive layer. Thus, the photoreceptor of the present invention can be designed with separating the above described functions required to the surface layer from the function of generating electric charge and of providing S-characteristic. This gives an increased degree of freedom of design.

The electrically conductive substrate may be opaque or substantially transparent. Examples of such an electrically conductive substrate include metals such as aluminum, nickel, chromium and stainless steel, plastic films or glass having a thin film of aluminum, titanium, nickel, chromium, stainless steel, gold, vanadium, tin oxide, indium oxide, ITO or the like formed thereon, and paper, plastic films or glass coated or impregnated with an electrically conducting agent. The electrically conductive substrate may be used in a proper form such as drum, sheet and plate, but not limited thereto. If necessary, the surface of the electrically conductive substrate may be subjected to various treatments as long as the resulting image quality is impaired. For example, the surface of the electrically conductive substrate may be subjected to oxidation, chemical treatment or coloring. Alternatively, the surface of the electrically conductive substrate may be grained to give irregular reflection.

Further, one or a plurality of undercoat layers may be provided between the electrically conductive substrate and the photosensitive layer (hereinafter, sometimes referred as to "photoconductive layer"). This undercoat layer acts to inhibit the injection of electric charge from the electrically conductive substrate into the photosensitive layer during charging of the photosensitive layer as well as acts as an adhesive layer for integrally attaching and retaining the photosensitive layer on the electrically conductive substrate. The undercoat layer acts to prevent the electrically conductive substrate from reflecting light in some cases.

Known materials may be used for the undercoat layer. Examples thereof include resins such as polyethylene resins, acrylic resins, methacrylic resins, polyamide resins, vinyl chloride resins, vinyl acetate resins, phenolic resins, polycarbonate resins, polyurethane resins, polyimide resins, vinylidene chloride resins, polyvinyl acetal resins, vinyl chloride-vinyl acetate copolymers, polyvinyl alcohol resins, water-soluble polyester resins, alcohol-soluble nylon resins, nitrocellulose, casein, gelatin, polyglutamic acid, startch, starch acetate, aminostarch, polyacrylic acids and polyacrylamides, copolymers made of two or more of these resins, and curable organic metal compounds such as zirconium alkoxide compounds, titanium alkoxide compounds and silane coupling agents. These compounds may be used singly or in combination of two or more thereof. Alternatively, a material which can transport only electric charge having the same polarity as the charging polarity can be used.

The thickness of the undercoat layer is preferably from 0.01 to 10 $\mu$m, more preferably from 0.05 to 5 $\mu$m. The application of the undercoat layer can be accomplished by an ordinary coating method such as blade coating method, wire bar coating method, spray coating method, dip coating method, bead coating method, air knife coating method and curtain coating method.

Known materials which have heretofore been used as a charge-generating layer in a J-character type laminated photoreceptor may be used as the charge-generating material for use in the charge-generating layer of the electrophotographic photoreceptor of the present invention. Examples of thereof include inorganic photoconductive materials such as amorphous selenium, selenium-telurium alloy, selenium-arsenic alloy, other selenium compounds, other selenium alloys, zinc oxide, titanium oxide and a-Si and a-SiC, and organic pigments and dyes such as phthalocyanine compounds, squarylium compounds, anthanthrone compounds, perylene compounds, azo compounds, anthraquinone compounds, pyrene compounds, pyrylium salts and thiapyrylium salts, but are not limited to these compounds. These organic pigments and dyes may be used singly or in combination of two or more thereof.

A phthalocyanine compound is well sensitive to light having a wavelength of from 600 nm to 850 nm, which wavelength is that of emission from LED or laser diode preferably used as a light source in digital electrophotograhic apparatus. Thus, this compound is particularly suitable as the charge-generating material. Specific examples of such a phthalocyanine compound include metal-free phthalocyanine, metal phthalocyanines, and dimers thereof. Examples of the central metal in the metal phthalocyanine include Cu, Ni, Zn, Co, Fe, V, Si, Al, Sn, Ge, Ti, In, Ga, Mg and Pb. Further, oxide, hydroxide, halide, alkylation product and alkoxylation product of these metals may be used. Specific examples of phthalocyanine compounds for use in the present invention include metal-free phthalocyanine, titanyl phthalocyanine, chlorogallium phthalocyanine, hydroxygallium phthalocyanine, 1,2-di(oxogalliumphthalocyanyl)ethane, vanadyl phthalocyanine, chloroindium phthalocyanine, dichlorotin phthalocyanine and copper phthalocyanine. Further, these phthalocyanine rings may have an arbitrary substituent. Moreover, any carbon atoms in these phthalocyanine rings may be substituted by nitrogen atom. These phthalocyanine compounds may be used in an amorphous form or any crystal form. These phthalocyanine compounds may be used singly or in combination of two or more thereof.

Among these phthalocyanine compounds, titanyl phthalocyanine, chlorogallium phthalocyanine, hydroxygallium phthalocyanine, 1,2-di(oxogalliumphthalocyanine) ethane, metal-free phthalocyanine, vanadyl phthalocyanine and dichlorotin phthalocyanine have excellent photosensitivity and thus are particularly preferred as the charge-generating material.

Among these crystalline phthalocyanine compounds, the compounds having the following crystal form are preferred. The metal-free phthalocyanine crystal is preferably of X-form. The vanadyl phthalocyanine crystal is preferably of $\alpha$-form. Preferred examples of the titanyl phthalocyanine crystal include those having strong diffraction peaks at least at 9.2°, 13.1°, 20.7°, 26.2° and 27.1°, those having at least at 7.6°, 12.3°, 16.3°, 25.3° and 28.7°, and hydrates having strong diffraction peaks at at least at 9.5°, 11.7°, 15.0° 23.5° and 27.3°, as Bragg angle (2θ±0.2°) in X-ray diffraction spectrum with CuK$\alpha$ as a radiation source. Preferred examples of the chlorogallium phthalocyanine crystal include those having strong diffraction peaks at least at 13.4° and 27.0°, and those having at least at 7.4°, 16.6°, 25.5° and 28.3°, as Bragg angle (2θ±0.2°) in X-ray diffraction spectrum with CuK$\alpha$ as a radiation source. Preferred examples of the hydroxygallium phthalocyanine crystal include those having strong diffraction peaks at least at 7.5°, 9.9°, 12.5°, 16.3°, 18.6°, 25.1° and 28.3° as Bragg angle (2θ±0.2°) in X-ray diffraction spectrum with CuK$\alpha$ as a radiation source. Preferred examples of the 1,2-di(oxogalliumphthalocyanyl) ethane crystal include those having strong diffraction peaks at least at 6.9°, 13.0°, 15.9°, 25.6° and 26.1° as Bragg angle (2θ±0.2°) in X-ray diffraction spectrum with CuK$\alpha$ as a radiation source. Preferred examples of the dichlorotin phthalocyanine crystal include those having strong diffraction peaks at least at 8.3°, 13.7° and 28.3°, those having at least at 8.5°, 11.2°, 14.5° and 27.2° and those having at least at 9.2°, 12.2°, 13.4°, 14.6°, 17.0° and 25.3° as Bragg angle (2θ±0.2°) in X-ray diffraction spectrum with CuK$\alpha$ as a radiation source.

While most phthalocyanine compounds act as a p-type semiconductor having a positive hole as main transport charge, dichlorotin phthalocyanine acts as a n-type semiconductor having electron as main transport charge. Therefore, an S-character type photoreceptor comprising dichlorotin phthalocyanine as a charge-generating material and having a charge-generating layer and a charge-transporting layer of hole-transporting type laminated on an electrically conductive substrate in this order exhibits a high sensitivity and can inhibit the injection of positive charge from the electrically conductive substrate when used in a negative charging process. Thus, such an S-character type photoreceptor exhibits good electrophotographic properties, i.e., decreased dark decay and high charge-ability and therefore is preferred in the present invention.

Further, hexagonal selenium has an excellent charge generation efficiency and thus can be preferably used as a charge-generating material. The shorter the wavelength of emission is, the smaller can be the diameter of laser beam. Thus, studies have been made to reduce the wavelength of exposing laser beam aiming at higher image quality. Hexagonal selenium is sensitive to a short wavelength range of not more than about 680 nm. Accordingly, hexagonal selenium is a particularly preferred charge-generating material for laser having this range of emission wavelength.

The charge-generating layer can be prepared by vacuum-evaporating the above described charge-generating material, or by dispersing or dissolving the above described charge-generating layer in a binder resin. Examples of the binder resin for use in the charge-generating layer include polyvinyl butyral resins, polyvinyl formal resins, partially-modified polyvinyl acetal resins, polycarbonate resins, polyester resins, acrylic resins, polyvinyl chloride resins, polystyrene resins, polyvinyl acetate resins, vinyl chloride-vinyl acetate copolymers, silicone resins, phenolic resins and poly-N-vinylcarbazole resins, but are not limited thereto. These binder resins may be used singly or in combination of two or more thereof. Further, the binder resin may be a block, random or alternating copolymer comprising two or more of these resins.

The mixing ratio (by volume) of the charge-generating layer and the binder resin is preferably from 10:1 to 1:10, more preferably 3:1 to 1:1. If the mixing ratio of the charge-generating layer to the binder resin exceeds the above defined range, it gives an increased dark decay and deteriorated mechanical properties. On the contrary, the mixing ratio of the charge-generating layer to the binder resin falls below the above defined range, it causes troubles such as photosensitivity drop and residual potential rise. The thickness of the charge-generating layer for use in the present invention is preferably from 0.05 to 5 μm, more preferably from 0.1 to 2.0 μm. The application of the charge-generating layer can be accomplished by an ordinary coating method such as blade coating method, wire bar coating method, spray coating method, dip coating method, bead coating method, air knife coating method and curtain coating method.

The interlayer to be provided between the charge-generating layer and the nonuniform charge-transporting layer generally comprises a charge-transporting matrix. Known materials which have been used as a charge-transporting layer in the conventional J-character type laminated photoreceptor may be used for the interlayer material. Examples of the interlayer material include solid solution films comprising an insulating resin (such as polycarbonates, polyacrylates, polyesters, polysulfones and polymethyl methacrylates) having uniformly dispersed therein one or more kinds of hole-transporting low molecular weight compounds (such as benzidine compounds, amine compounds, hydrazone compounds, stilbene compounds and carbazole compounds) and electron-transporting low molecular weight compounds (such as fluorenone compounds, malononitrile compounds and diphenoquinone compounds); and a charge-transporting polymer having charge-transporting ability per se. Alternatively, an inorganic substance having charge-transporting ability such as selenium, amorphous silicon and amorphous silicon carbide may be used. Examples of the charge-transporting polymer include polymer having a charge-transporting group in its side chain such as polyvinyl carbazole, polymer having a charge-transporting group in its main chain as disclosed in JP-A-5-232727, and polysilane. The content of the charge-transporting low molecular weight compound in the solid solution film for use as the interlayer is generally from 1 to 70% by weight.

The above described interlayer is provided in such an arrangement that the charge-generating material and the nonuniform charge-transporting layer are not brought into direct contact with each other. Thus, the interlayer can inhibit the rise in dark decay and the drop in stability, giving improvements in chargeability and stability. In case that the charge-generating material which gives a higher charge generation efficiency when the charge-generating layer comes into contact with a charge-transporting material is used, the interlayer can provide a higher sensitivity. Further, the interlayer can help the injection of charge from the charge-generating layer into the nonuniform charge-transporting layer to reduce the residual potential.

The interlayer may contain an electrically inactive domain surrounded by the charge-transporting matrix.

In the present invention, the thickness of the interlayer is generally selected from a range of from 0.1 to 10 μm, preferably from 0.2 to 5 μm. If the thickness of the interlayer falls below the above defined range, the interlayer cannot fully exert its effect. If the thickness of the interlayer exceeds the above defined range, the interlayer exhibits a deteriorated S-characteristic. The application of the interlayer can be accomplished by any ordinary coating method such as blade coating method, wire bar coating method, spray coating method, dip coating method, bead coating method, air knife coating method and curtain coating method. If the interlayer material can be subjected to gas phase film formation, it can be directly formed into a film by vacuum-evaporation method.

The S-character type charge-transporting layer is a layer having formed therein a charge-transporting passage which has a nonuniform structure and comprises a charge-transporting domain dispersed in an electrically inactive matrix. The preparation of the S-character type charge-transporting layer can be accomplished by any appropriate method. For example, a fine particulate charge-transporting material may be dispersed in a solution of an insulating binder resin dissolved in an appropriate solvent to prepare a coating solution, followed by dip-coating the coating solution. The coated material is then dried to obtain the S-character type charge-transporting layer. Alternatively, a particulate fine charge-transporting material which has been coated with an insulating material such as thermosetting resins and silane coupling agents so that it is insolubilized may be dispersed in a solution of an insulating binder resin dissolved in an appropriate solvent to prepare a coating solution, followed by dip-coating the coating solution. The coated material is then dried to obtain the S-character type charge-transporting layer. Further, a uniform dispersion of a charge-transporting substance in an insulating binder resin may be subjected to heat treatment, solvent treatment or the like so that microcrystallines of the charge-transporting material is deposited to obtain the S-character type charge-transporting layer. Moreover, a block copolymer or graft copolymer comprising an insulating block and a charge-transporting block having a sea-island structure in which the insulating block and the charge-transporting block undergo microphase separation so that the charge-transporting block forms an "island" can be also used.

In these formation method of the S-character type charge-transporting layer, the formation of the contorted charge-transporting passage depends on the probable contact between charge-transporting domains. If the probability of the contact is too great, the resulting charge-transporting passage is not contorted. On the contrary, if the probability of the contact is too low, a charge-transporting passage cannot be formed. These charge-transporting domains do not necessarily need to come into direct contact with each other. The very thin insulating layer between the charge-transporting domains can be tolerated as long as electric charge can skip over the insulating gap and the capture of electric charge thereby can be neglected. The term "contorted charge-transporting passage" as used herein means a charge-transporting passage formed such that electric charge migrates vertically backward once or more times with respect to the thickness direction of the layer.

More particularly, the S-character type charge-transporting layer can be formed by a dispersion of a fine particulate charge-transporting material in an appropriate binder resin. Examples of the material constituting the fine particulate charge-transporting material include inorganic materials such as hexagonal selenium, cadmium selenide, other selenium compounds, other selenium alloys, cadmium sulfide, zinc oxide, titanium oxide, a-Si and a-SiC; organic pigments such as phthalocyanine compounds, squarylium compounds, anthanthrone compounds, perylene compounds, azo compounds, anthraquinone compounds, pyrene compounds, pyrylium salts and thiapyrylium salts; hole-transporting low molecular weight compounds such as benzidine compounds, amine compounds, hydrazone compounds, stilbene compounds and carbazole compounds; and electron-transporting low molecular weight compounds such as fluorenone compounds, malononitrile compounds and diphenoquinone compounds, but are not limited to these compounds. These charge-transporting materials may be used singly or in combination of two or more thereof. Some of the organic pigment exhibit charge-generating function with respect to light of exposing wavelength as well as charge-transporting function when used for the charge-transporting domain.

The hexagonal selenium crystal does not substantially absorb light having a wavelength of not less than 700 nm, which wavelength is that of emission from a laser diode which is preferably used as a light source for digital electrophotographic apparatus at present. Further, the hexagonal selenium crystal has excellent charge-transporting ability. Thus, the hexagonal selenium crystal is particularly preferred as the fine particulate charge-transporting material for use in the S-character type charge-transporting layer.

Examples of the binder resin as the electrically inactive matrix include polyvinyl butyral resins, polyvinyl formal resins, partially-modified polyvinyl acetal resins, polycarbonate resins, polyester resins, acrylic resins, polyvinyl chloride resins, polystyrene resins, polyvinyl acetate resins, vinyl chloride-vinyl acetate copolymers, silicone resins and phenolic resins, but are not limited to these binder resins. These binder resins may be used singly or in combination of two or more thereof. Further, the binder resin may be a block, random or alternating copolymer comprising two or more of these resins.

The volume resistivity of the binder resin used as electrically inactive matrix is preferably not less than $10^{13}$ Ω·cm, more preferably not less than $10^{14}$ Ω·cm. If the volume resistivity of the electrically inactive matrix falls below this range, the electrical insulation property of the electrically inactive matrix is impaired, being apt to eliminate the S-characteristic of the resulting electrophotographic photoreceptor.

The volume ratio of the charge-transporting domain to the electrically inactive matrix is arbitrarily selected from a range of generally from 3/1 to 1/20, preferably from 7/3 to 1/10. In the case where the charge-transporting domain is not insulating-coated and is in an amorphous form or almost spheric form, the volume ratio of the charge-transporting domain to the electrically inactive matrix is more preferably from 4/6 to 2/8. If the volume ratio of the charge-transporting domain exceeds the above defined range, the charge-transporting domains tends to come into close contact with each other, causing the formation of a charge-transporting passage having a substantially uniform structure. Thus, the nonuniformity in the structure of charge-transporting passage, which is indispensable for the realization of the above described S-character type photo-induced potential decay characteristics, tends to be eliminated, and therefore the S-characteristic is lost. Further, troubles such as the increase in dark decay or the deteriorated mechanical strength tend to be caused. On the contrary, if the volume ratio of the charge-transporting domain falls below the above defined range, this cause a tendency such that sufficient charge-transporting ability cannot be obtained, causing troubles such as increased residual potential, deteriorated photosensitivity and lowered response speed. However, referring to the former problem, the above described more preferred range of from 4/6 to 2/8 can be extended to the range of from 7/3 to 2/8 by, for example, incompletely coating the grains constituting the charge-transporting domain beforehand with an electrically inactive substance. This is because the insulating coating can lower the probability of electrical contact between the charge-transporting domains, and because the incomplete insulating coating can form a contorted charge-transporting passage. Referring to the latter problem, the above described more preferred range of from 4/6 to 2/8 can be extended to the range of from 4/6 to 1/10 by, for example, using an acicular, columnar or tabular particulate material as a charge-transporting domain. This is because the probability of contact between the charge-transporting domains can be kept effectively by the use of an acicular, columnar or tabular particulate material as a charge-transporting domain even if the volume ratio of the charge-transporting domain is low.

Further, if the S-character type charge-transporting layer is formed by the application of a dispersion of a fine particulate charge-transporting material in an insulating binder resin, the application of the coating solution is preferably effected with a solvent which does not dissolve the fine particulate charge-transporting material therein. This is because if a solvent which dissolves the fine particulate charge-transporting material therein is used, substances constituting the fine particulate charge-transporting material contaminate the insulating binder resin in a molecularly dispersed manner, impairing the insulation properties of the electrically inactive matrix. Hence, the S-characteristic of the resulting electrophotographic photoreceptor tends to be deteriorated.

Another process for the formation of the S-characteristic type charge-transporting layer comprises the crystallization of a charge-transporting dye or molecule in a solid solution with an insulating binder resin to cause the dye or molecule to be deposited in the form of microcrystal, causing phase separation.

A further process for forming the S-character type charge-transporting layer comprises the use of a system having an "sea-island" structure comprising a block copolymer or graft copolymer made of an electrically inactive insulating block and a charge-transporting block in which the insulating block and the charge-transporting block undergo microphase separation in such an arrangement that the charge-transporting domain forms an "island". In particular, an "sea-island" structure in which the charge-transporting domain forms an "island" is preferred. Examples of the block or graft copolymer employable herein include multi-block copolymer prepared by the copolymerization of vinyl carbazole and dodecyl methacrylate as disclosed in U.S. Pat.

No. 3,994,994. Other examples of the block or graft copolymer employable herein include those described in U.S. Pat. Nos. 4,618,551, 4,806,443, 4,818,650, 4,935,487, and 4,956,440, block copolymer which comprises low molecular weight polysiloxane, aliphatic and aromatic polyesters and containing polyurethane units and is prepared by condensation. The volume resistivity of a single resin made of only an insulating block of these block copolymer is preferably not less than $10^{13}$ Ω·cm, more preferably not less than $10^{14}$ Ω·cm. If an insulating block having a volume resistivity falling below the above defined range is used, the electrical insulating properties of the electrically inactive matrix formed by the block tends to be impaired, eliminating the S-characteristic.

The thickness of the S-character type charge-transporting layer is preferably from 0.1 to 50 μm, more preferably from 0.2 to 15 μm, particularly preferably from 0.5 to 5 μm. If the thickness of the S-character type charge-transporting layer falls below the above defined range, the S-characteristic tends to be lost. The upper limit of the thickness of the S-character type charge-transporting layer is governed by the charge-transporting ability of the S-character type charge-transporting layer used and can be predetermined to a range tolerated by response speed, residual potential, etc.

The average grain diameter of the charge-transporting domains is preferably from 0.001 to 1 μm, more preferably from 0.005 to 0.5 μm, particularly from 0.01 to 0.2 μm. If the average grain diameter of the charge-transporting domains exceeds the above defined range, the probability of forming the nonuniform structure of charge-transporting passage required for the realization of S-characteristic within the preferred range of film thickness is lowered, eliminating the desired S-characteristic. On the contrary, if the average grain diameter of the charge-transporting domains falls below the above defined range, the resulting charge-transporting passage has an almost uniform structure, eliminating the S-characteristic. When the charge-transporting domain in the S-character type charge-transporting layer is made of an aggregate of a fine particulate charge-transporting material, the grain diameter of the charge-transporting domain as used herein indicates the aggregated secondary grain diameter. However, when the particulate charge-transporting material is insulating-coated, the grain diameter of the charge-transporting domain as used herein indicates the grain diameter of the fine particulate charge-transporting material itself even if the insulating-coated fine particulate charge-transporting material forms an aggregate.

By incorporating a compound capable of transporting only an electric charge having the polarity opposite that of the main transport charge into the S-character type charge-transporting layer, effects can be attained such as reducing residual potential and improving repetition stability.

The application of the S-character type charge-transporting layer can be accomplished by any ordinary method such as blade coating method, wire bar coating method, spray coating method, dip coating method, bead coating method, air knife coating method and curtain coating method.

The uniform charge-transporting layer, i.e., layer made of a charge-transporting matrix may comprise a known material which has been used as the charge-transporting layer of the conventional J-character type laminated photoreceptors. Examples of such a material employable herein include a solid solution film comprising an insulating resin (such as polycarbonates, polyacrylates, polyesters, polysulfones and polymethyl methacrylate) having uniformly dispersed therein one or more kinds of hole-transporting low molecular weight compounds (such as benzidine compounds, amine compounds, hydrazone compounds, stilbene compounds and carbazole compounds) and electron-transporting low molecular weight compounds (such as fluorenone compounds, malononitrile compounds and diphenoquinone compounds); and a charge-transporting polymer which has charge-transporting ability per se. Alternatively, an inorganic substance having charge-transporting ability such as selenium, amorphous silicon and amorphous silicon carbide may be used. Examples of the charge-transporting polymer include polymers having a charge-transporting group in its side chain such as polyvinyl carbazole; polymers having a charge-transporting group in its main chain as disclosed in JP-A-5-232727; and polysilane.

The uniform charge-transporting layer for use in the present invention preferably comprises a charge-transporting polymer particularly taking into account the production process. That is, when an S-character type charge-transporting layer and a uniform charge-transporting layer are laminated, if the uniform charge-transporting layer is made of a charge-transporting low molecular weight compound, the charge-transporting low molecular weight compound contaminates the S-character type charge-transporting layer, lowering the insulation property of the electrically inactive matrix in the S-character type charge-transporting layer to main electric charge. Thus, the resulting electrophotographic photoreceptor exhibits a deteriorated S-characteristic. Further, the contaminating molecules act as charge traps to cause troubles such as residual potential rise, transporting ability drop and photosensitivity drop. This problem becomes remarkable particularly when the wet coating method is employed to form the various layers. Of course, these problems can be solved by selecting a solvent which can hardly dissolve or swell the lower layer as a coating solvent for the upper layer, or by selecting a compound incompatible with the charge-transporting low molecular weight compound as the electrically inactive matrix. However, it is known that polymers normally undergo phase separation rather than mutual dissolution. Thus, if the uniform charge-transporting layer is made of a charge-transporting polymer, the charge-transporting polymer undergoes phase separation without undergoing mutual dissolution with the electrically inactive matrix resin in the S-character type charge-transporting layer, causing little or no contamination problem as described above. Thus, the use of the charge-transporting polymer provides an advantage of that the limitation in selecting the materials and the preparation method is eliminated.

For the above described reason, when a uniform charge-transporting layer comprises a charge-transporting polymer, the content of charge-transporting compounds having a molecular weight of not more than 1,000 in the uniform charge-transporting layer is preferably less than 5% by weight based on the weight of the uniform charge-transporting layer.

Charge-transporting resins having at least one structure represented by the following general formula (1) as a repeating unit are particularly preferably used as the charge-transporting polymer because it impart high charge-transporting ability and excellent mechanical properties to the resulting uniform charge-transporting layer.

(1)

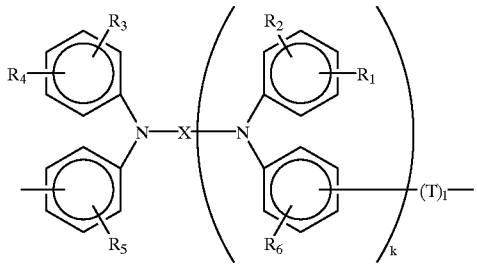

wherein $R_1$ to $R_6$ each independently represents a hydrogen atom, an alkyl or alkoxy group generally having from 1 to 10 carbon atoms, a substituted amino group, a halogen atom or a substituted or unsubstituted aryl group; X represents a divalent hydrocarbon or hetero atom-containing divalent hydrocarbon group containing a substituted or unsubstituted aromatic ring; T represents a divalent hydrocarbon or hetero atom-containing divalent hydrocarbon group which has from 1 to 20 carbon atoms and which may be branched or contain a ring structure; and k and 1 each represents an integer of 0 or 1.

Examples of the substituted amino group represented by $R_1$ to $R_6$ include methylamino, dimethylamino, ethylamino, diethylamino, phenylamino, diphenylamino and piperidinoamino.

Examples of the substituent on the aryl group represented by $R_1$ to $R_6$ include alkyl groups (e.g., —Me, —$CH_2CH_3$, —$C(CH_{3),\ -CH(CH}3)2$), alkoxy groups (e.g., —$OCH_3$), halogen atoms (e.g., chlorine atom), aryl group (e.g., phenyl), carboxyl group and hydroxyl group.

Examples of the substituted or unsubstituted aryl group represented by $R_1$ to $R_6$ include:

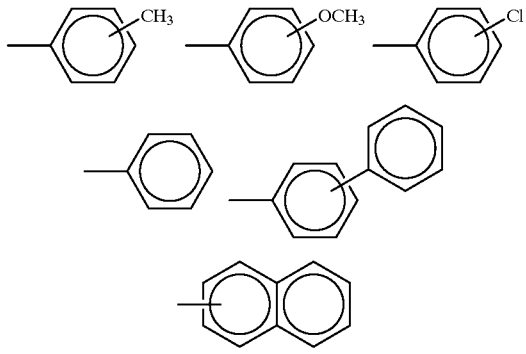

Examples of the group represented by X include:

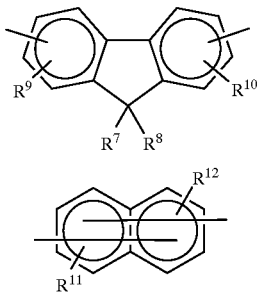

-continued

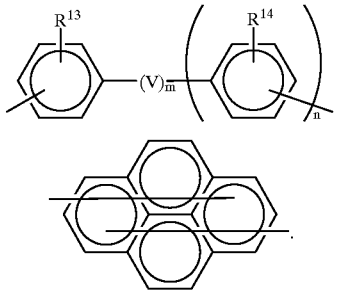

wherein R7 to R15 each independently represents a hydrogen atom, an alkyl or alkoxy group having from 1 to 4 carbon atoms, a phenyl group or a halogen atom; V represents alkylene group having from 1 to 8 carbon atoms, an alkylidene group having from 1 to 8 carbon atom, a vinylene group, a phenylene group, an imino group, an oxy group or an thio group; and m and n each represents an integer of 0 or 1.

Examples of the substituent on the aromatic ring contained in the group represented by X include alkyl groups (e.g., —Me, —$CH_2CH_3$, —$C(CH_3)$, —$CH(CH_3)_2$), alkoxy groups (e.g., —$OCH_3$), halgen atoms (e.g., chlorine atom), aryl group (e.g., phenyl), carboxyl group and hydroxyl group.

Specific examples of X include:

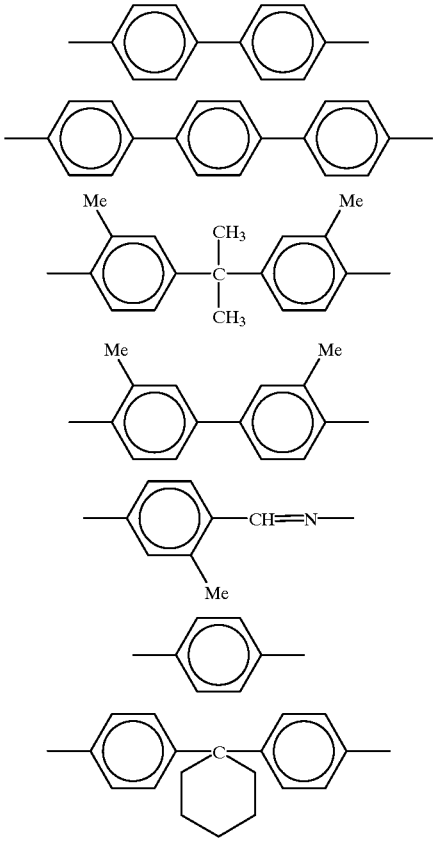

-continued

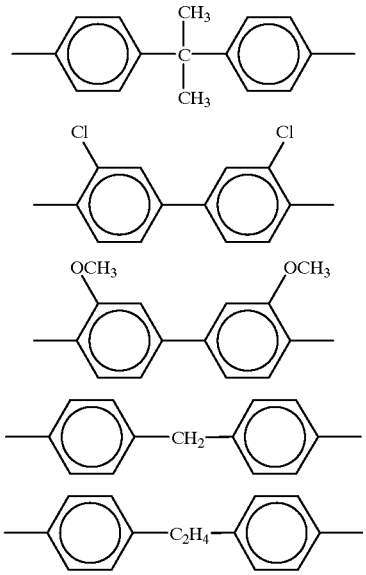

Examples of the group represented by T include:

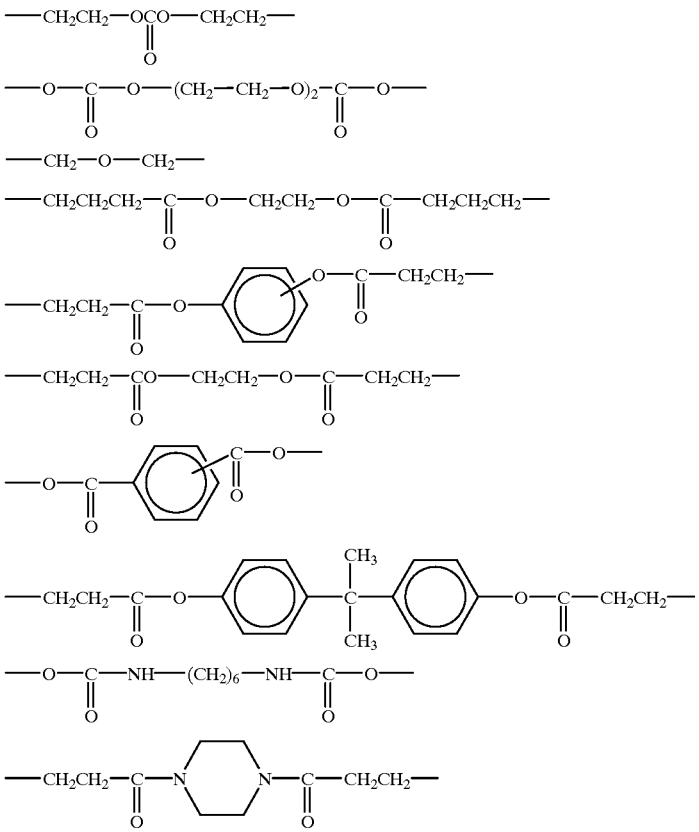

An electrically conductive domain surrounded by the charge-transporting matrix may be present in the uniform charge-transporting layer. For example, the uniform charge-transporting layer may comprise a particulate insulating material for reducing the surface friction, surface abrasion or surface deposit. The addition amount of the particulate insulating material is generally from 0.1 to 30% by volume based on the volume of the uniform charge-transporting layer. The uniform charge-transporting layer may comprise a particulate charge-transporting material or the like for enhancing the transporting ability or like purposes.

The thickness of the uniform charge-transporting layer for use in the present invention is selected from a range of from 1 to 50 μm, preferably from 5 to 30 μm. The application of the uniform charge-transporting layer can be accomplished by any ordinary method such as blade coating method, wire bar coating method, spray coating method, dip coating method, bead coating method, air knife coating method and curtain coating method. If the charge-transporting material used can be subjected to gas phase film formation, it can be directly formed into a film by vacuum-evaporation method.

In the present invention, the total thickness of the charge-transporting layer is preferably from 5 to 50 μm, more preferably from 10 to 40 μm.

If the charge-transporting layer is disposed between the charge-generating layer and the exposing light source, it is preferred that the charge-transporting layer be substantially transparent to light of exposure wavelength to inhibit the drop of effective photosensitivity. The transmittance of the whole charge-transporting layer to exposing light is preferably not less than 50%, more preferably not less than 70%, particularly not less than 90%. If it is desired to use the electrophotographic photoreceptor at a low sensitivity, a charge-transporting layer having substantial absorption of light having exposure wavelength may be used to adjust the effective photosensitivity. However, if the S-character type charge-transporting layer absorbs light and has a charge-generating ability, S-characteristic thereof tends to be impaired. Therefore, it is desired that the S-character type charge-transporting layer be substantially transparent to light of exposure wavelength. The absorptance of the S-character type charge-transporting layer to exposing light is preferably not more than 30%, more preferably not more than 20%, further preferably not more than 10%. The term "light absorptance" as used herein means the inherent light absorptance of the film excluding light reflection and scattering.

A protective layer may be provided on the photoconductive layer comprising a charge-generating layer and a charge-transporting layer as necessary. This protective layer protects the photoconductive layer from chemical stress by ozone or oxidizing gas generated from the charging member, by ultraviolet rays or the like, or mechanical stress caused by contact with the developer, paper, cleaning member or the like. Thus, the protective layer is effective for the prolongation of the substantial life of the photoconductive layer. The protective layer is particularly effective for the layer structure in which a thin charge-generating layer is provided as an upper layer.

The protective layer may be formed by incorporating an electrically conductive material in an appropriate binder resin. Examples of the electrically conductive material include a metallocene compounds such as dimethylphellocene, or metal oxides such as antimony oxide, tin oxide, titanium oxide, indium oxide and ITO, but are not limited thereto. Examples of the binder resin include known resins such as polyamides, polyurethanes, polyesters, polycarbonates, polystyrenes, polyacrylamides, silicone resins, melamine resins, phenolic resins and epoxy resins. Further, an electrically conductive inorganic film made of amorphous carbon or the like may be used as the protective layer.

The electrical resistance of the protective layer is preferably from $10^9$ to $10^{14}$ Ω·cm. If the electrical resistance of the protective layer exceeds the above defined range, it causes a rise in the residual potential. On the contrary, if the electrical resistance of the protective layer falls below the above defined range, leakage of electric charge along the surface of the layer become too marked to be neglected, reducing the resolving power.

The thickness of the protective layer is preferably from 0.5 to 20 μm, more preferably from 1 to 10 μm.

When any protective layer is provided, a blocking layer for inhibiting the leakage of electric charge from the protective layer to the photosensitive layer may be provided between the photosensitive layer and the protective layer. The blocking layer may comprises any known material as in the case of the protective layer.

The electrophotographic photoreceptor of the present invention may comprise an oxidation inhibitor, a light stabilizer, a heat stabilizer or the like in the respective layers or only the uppermost layer for inhibiting deterioration of the photoreceptor by ozone or oxidizing gas generated in the electrophotographic apparatus, or by light or heat.

Examples of the oxidation inhibitor include known oxidation inhibitors. Specific examples of such a known oxidation inhibitor include hindered phenols, hindered amine, paraphenylene diamine, hydroquinone, spirochromane, spiroindanone, derivative of these compounds, organic sulfur compounds, and organic phosphorus compounds.

Examples of the light stabilizer include known light stabilizers. Specific examples of such a known light stabilizer include derivative compounds of benzophenone, benzotriazole, dithiocarbamate and tetramethylpiperidine, and electron attractive compounds or electron donative compounds which undergo energy transfer or charge migration to deactivate the photo-excited state.

For reducing the surface abrasion and for improving the transferability and cleaning properties, the outermost layer may comprise insulating grains of fluorine-containing resin or the like.

If the nonuniform charge-transporting layer for use in the present invention has charge-generating ability, S-characteristic can be realized even if the charge-generating layer is omitted. Therefore, this constitution of an electrophotographic photoreceptor is included in the present invention as one embodiment.

Referring to the conventional laminated electrophotographic photoreceptor, a structure comprising a plurality of charge-generating layers or charge-transporting layers or a structure comprising a photoconductive undercoat layer or protective layer is known. However, these electrophotographic photoreceptors have been worked out for the improving the photosensitivity, wavelength range of light to which the photographic material is sensitive and response in the J-character type laminated photoreceptor. The present inventors made supplementary examination on these embodiments. As a result, it was confirmed that any of these embodiments does not have the objective S-characteristic, i.e., $E_{50\%}/E_{10\%}$ of less than 5. The substantial difference between these laminated photoreceptor and the electrophotographic photoreceptor of the present invention is the difference in the structure of charge-transporting passage in the layer present between the most remote charge-generating layer and the charge-transporting layer. In other words, in the conventional laminated electrophotographic photoreceptor, the structure of charge-transporting passage in the layer present between the most remote charge-generating layer and the charge-transporting layer is designed so uniform or substantially uniform (due to too high a volume ratio of transporting domain or lowered insulation properties of the electrically inactive matrix caused by the contamination of the charge-transporting material) that smooth movement of electric field essential for J-characteristic is realized. Thus, these embodiment do not include the substantially nonuniform structure which brings about the S-characteristic of the present invention.

The electrophotographic apparatus on which the electrophotographic photoreceptor of the present invention is mounted may be of any type as long as it employs electrophotography. In particular, an electrophotographic apparatus in which an exposure is carried out in accordance with digitized image signals is preferred. In such an electrophotographic apparatus, laser or LED is used as a light source. A binary light or multinary light obtained by pulse width modulation or intensity modulation is used exposing light. Examples of such an electrophotographic apparatus include LED printers, laser printers and laser exposure type digital copying machines.

For initializing the photoreceptor after development or for stabilizing the electrophotographic properties, another exposing light source may be used besides the exposing light source for forming image. The emission of the light source may or may not be absorbed by the S-character type charge-transporting layer. However, it is preferred that the light from this light source reach at least the charge-generating layer.

The present invention will be further described in detail with reference to the following examples, but the present invention should not be construed as being limited thereto. Those skilled in the art can made modifications on the following examples on the basis of known knowledge of electrophotographic technique.

EXAMPLE 1

4 parts by weight of dichlorotin phthalocyanine crystal having strong diffraction peaks at least at 8.3°, 13.7° and 28.3° as Bragg angle (2θ±0.2°) in X-ray spectrum with CuKα as a radiation source was mixed with 2 parts by weight of a polyvinyl butyral resin (trade name: S-Lec BN-S, available from Sekisui Chemical Co., Ltd.) and 100 parts by weight of n-butanol. The mixture was then subjected to dispersion with glass beads by a paint shaking method for 2 hours. The dispersion thus obtained was applied to an aluminum substrate by a dip coating method, and then dried at a temperature of 115° C. for 10 minutes to form a charge-generating layer having a thickness of 0.5 μm.

Subsequently, 15 parts by weight of hexagonal microcrystalline selenium, 8 parts by weight of a vinyl chloride-vinyl acetate copolymer (trade name: UCAR Solution Vinyl Resin VMCH, available from Union Carbide Co., Ltd.; electrical resistivity: $10^{14}$ Ω·cm) and 100 parts by weight of isobutyl acetate were subjected to dispersion with stainless steel beads having a diameter of 3 mm by an attritor for 200 hours. The dispersion thus obtained was applied to the above described charge-generating layer by a dip coating method, and then dried at a temperature of 115° C. for 10 minutes to form an S-character type charge-transporting layer having a thickness of 2 μm. The volume ratio of the hexagonal selenium crystal in the S-character type charge-transporting layer was about 35%. The average grain diameter of the hexagonal selenium crystal was 0.05 μm.

Subsequently, a coating solution obtained by dissolving 15 parts by weight of a compound having a viscosity average molecular weight of 80,000 and comprising a repeating unit represented by the following structural formula (2) as a charge-transporting polymer material in 85 parts by weight of monochlorobenzene was applied to the S-character type charge-transporting layer by a dip coating method, and then dried at a temperature of 135° C. for 1 hour to form a uniform charge-transporting layer having a thickness of 20 μm. Thus, an electrophotographic photoreceptor having the layer structure shown in FIG. 3 was prepared.

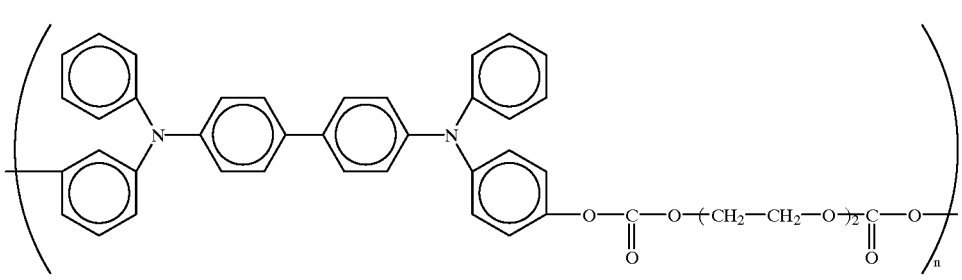

(2)

Figure 9:
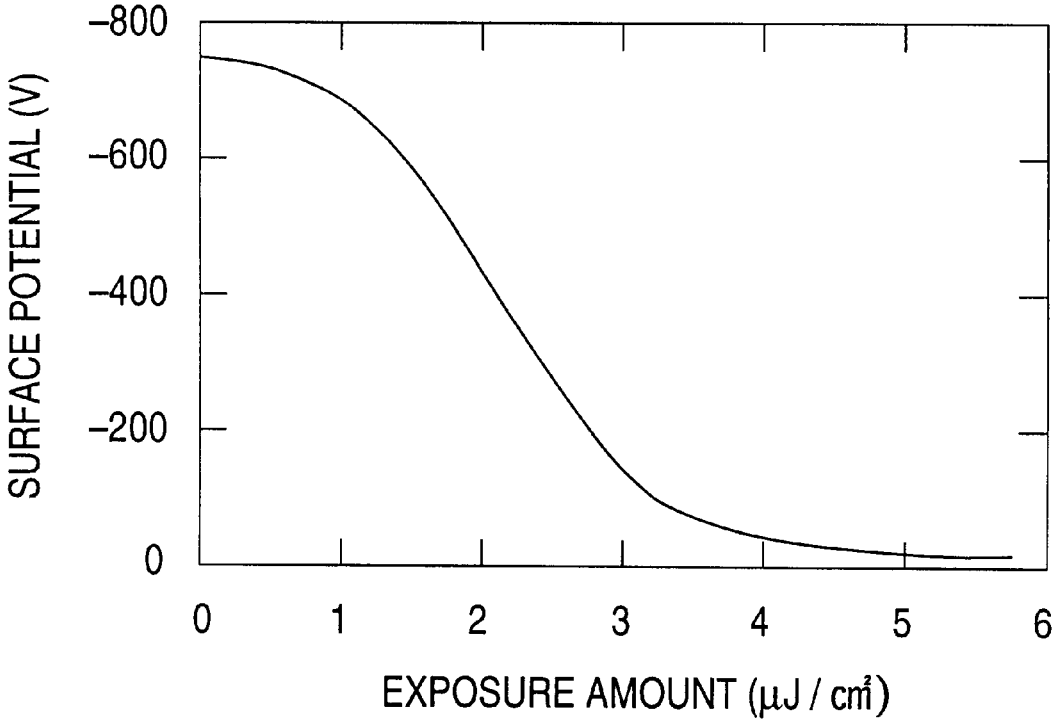
FIG. 9 is a graph illustrating the photo-induced potential decay characteristics of the electrophotographic photoreceptor used in Example 1.

Using a partly-modified version of an electrostatic copying paper testing apparatus (Electrostatic Analyzer EPA-8100, available from Kawaguchi Denki Seisakusho K.K.), the electrophotographic photoreceptor thus obtained was evaluated for electophotographic properties in an atmosphere of ordinary temperature and humidity (20° C., 40% RH). In some detail, the corona discharge voltage was adjusted to charge the surface of the photoreceptor to −750 V. The photoreceptor was then irradiated with monochromatic light having a wavelength of 750 nm obtained by passing light from a halogen lamp through an interference filter, the intensity of which light had been adjusted to 1 μW/cm$^2$ on the surface of the photoreceptor, for 7 seconds. As a result, the electrophotographic photoreceptor exhibited an S-character type photo-induced potential decay as shown in FIG. 9. The potential developed after irradiation with light is herein referred to as residual potential. From this photo-induced potential decay curve, $E_{50\%}$ value and $E_{50\%}/E_{10\%}$ value were determined as 2.2 μJ/cm$^2$ and 1.7, respectively. The residual potential was 10 V.

The transmittance of the whole charge-transporting layer to light having a wavelength of 750 nm was 85%. The absorptance of the S-character type charge-transporting layer to light having a wavelength of 750 nm was 5%. For the measurement of the light transmittance of the whole charge-transporting layer, an S-character type charge-transporting layer and a uniform charge-transporting layer were formed on a glass plate in the same manner as described above, and the transmittance thereof was measured with a self-recording spectrophotometer U-4000 available from Hitachi, Ltd. For the measurement of the light absorptance of the S-character type charge-transporting layer, an S-character type charge-transporting layer was formed on a glass plate in the same manner as described above. Using the self-recording spectrophotometer U-4000 available from Hitachi, Ltd., the sample was then measured for reflectance (a black plate was disposed on the back side of the sample) and transmittance. From these measurements, the light absorptance was calculated by the following equation:

$$(\text{Absorptance})=1-[(\text{Transmittance})+(\text{Reflectance})]$$

COMPARATIVE EXAMPLE 1

An electrophotographic photoreceptor was prepared in the same manner as in Example 1, except that the S-character type charge-transporting layer was not applied.

Figure 1:
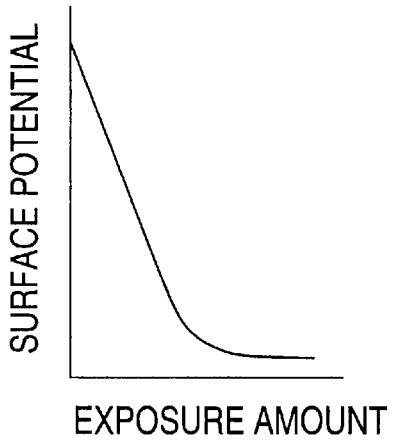
FIG. 1 is a graph illustrating the relationship between exposure amounts and surface potentials of a J-character type electrophotographic photoreceptor.
Figure 2:
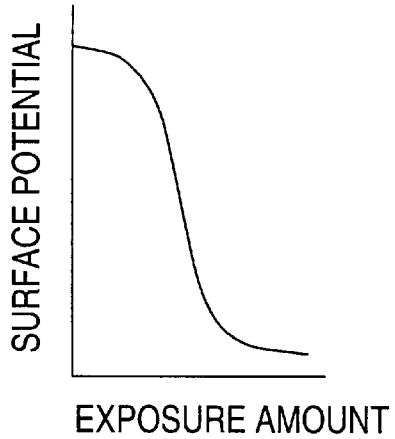
FIG. 2 is a graph illustrating the relationship between exposure amounts and surface potentials of an S-character type electrophotographic photoreceptor.

The electrophotographic photoreceptor thus obtained was evaluated for electrophotographic properties in the same manner as in Example 1. As a result, a photo-induced potential decay curve as shown in FIG. 1, which is not of S-character type, was obtained. From this photo-induced potential decay curve, $E_{50\%}/E_{10\%}$ value was determined as 5.5.

COMPARATIVE EXAMPLE 2

An electrophotographic photoreceptor was prepared in the same manner as in Example 1, except that the charge-generating layer was not applied. The electrophotographic photoreceptor thus obtained was evaluated for electrophotographic properties in the same manner as in Example 1. As a result, the electrophotographic photoreceptor exhibited no photosensitivity.

It is apparent from the comparison of the results obtained in Example 1 with those in comparative Examples 1 and 2 that the S-character type charge-transporting layer realizes an S-characteristic without contributing to the generation of electric charge.

EXAMPLE 2

An electrophotographic photoreceptor was prepared in the same manner as in Example 1, except that the addition amount of the hexagonal selenium was changed such that the volume ratio of the hexagonal selenium crystal in the S-character type charge-transporting layer was changed from 35% to 25%.

The electrophotographic photoreceptor thus obtained was then evaluated for photo-induced potential decay characteristics in the same manner as in Example 1. As a result, $E_{50\%}$ value was 3.1 $\mu J/cm^2$, and $E_{50\%}/E_{10\%}$ value was 1.7, demonstrating that the electrophotographic photoreceptor is of S-character type.

The electrophotographic photoreceptor was also measured for light transmittance and absorptance. As a result, the whole charge-transporting layer exhibited a transmittance of 88% with respect to light having a wavelength of 750 nm. The S-character type charge-transporting layer exhibited an absorptance of 4% with respect to light having a wavelength of 750 nm.

EXAMPLE 3

An electrophotographic photoreceptor was prepared in the same manner as in Example 1, except that the addition amount of the hexagonal selenium was changed such that the volume ratio of the hexagonal selenium crystal in the S-character type charge-transporting layer was changed from 35% to 15%.

The electrophotographic photoreceptor thus obtained was then evaluated for photo-induced potential decay characteristics in the same manner as in Example 1. As a result, $E_{50\%}$ value was 5.5 $\mu J/cm^2$, and $E_{50\%}/E_{10\%}$ value was 1.9, demonstrating that the electrophotographic photoreceptor is of S-character type.

The electrophotographic photoreceptor was also measured for light transmittance and absorptance. As a result, the whole charge-transporting layer exhibited a transmittance of 90% with respect to light having a wavelength of 750 nm. The S-character type charge-transporting layer exhibited an absorptance of 3% with respect to light having a wavelength of 750 nm.

EXAMPLE 4

An electrophotographic photoreceptor was prepared in the same manner as in Example 1, except that the addition amount of the hexagonal selenium was changed such that the volume ratio of the hexagonal selenium crystal in the S-character type charge-transporting layer was changed from 35% to 45%.

The electrophotographic photoreceptor thus obtained was then evaluated for photo-induced potential decay characteristics in the same manner as in Example 1. As a result, $E_{50\%}$ value was 1.9 $\mu J/cm^2$, and $E_{50\%}/E_{10\%}$ value was 3.6, demonstrating that the electrophotographic photoreceptor is of S-character type.

The electrophotographic photoreceptor was also measured for light transmittance and absorptance. As a result, the whole charge-transporting layer exhibited a transmittance of 75% with respect to light having a wavelength of 750 nm. The S-character type charge-transporting layer exhibited an absorptance of 9% with respect to light having a wavelength of 750 m.

From the comparison of the results obtained Examples 1 to 4, it is understood that there is an optimum mixing ratio of the electrically inactive matrix and the charge-transporting domain in the S-character type charge-transporting layer, and that the optimum volume ratio of the electrically inactive matrix in the S-character type charge-transporting layer is from 20 to 40%.

EXAMPLE 5

A solution of 10 parts by weight of a zirconium alkoxide compound (trade name: Orgatics ZC540, available from Matsumoto Chemical Industry Co., Ltd.) and 1 part by weight of a silane compound (trade name: A1110, available from Nippon Unicar Co., Ltd.) in a mixture of 40 parts by weight of isopropanol and 20 parts by weight of butanol was applied to an aluminum substrate by a dip coating method, and then dried at a temperature of 150° C. for 10 minutes to form an undercoat layer having a thickness of 0.1 $\mu$m. Subsequently, 4 parts by weight of microcrystalline chlorogallium phthalocyanine having strong diffraction peaks at least at 7.4°, 16.6°, 25.5° and 28.3° as Bragg angle ($2\theta \pm 0.2°$) in X-ray diffraction spectrum with CuK$\alpha$ as a radiation source was mixed with 2 parts by weight of a vinyl chloride-vinyl acetate copolymer (trade name: UCAR Solution Vinyl Resin VMCH, available from Union Carbide Co., Ltd.), 67 parts by weight of xylene and 33 parts by weight of butyl acetate. The mixture was then subjected to dispersion with glass beads by a paint shaking method for 2 hours. The coating solution thus obtained was applied to the above described undercoat layer by a dip coating method, and then dried at a temperature of 100° C. for 10 minutes to form a charge-generating layer having a thickness of 0.5 $\mu$m.

Subsequently, 15 parts by weight of hexagonal microcrystalline selenium, 10 parts by weight of a vinyl chloride-vinyl acetate copolymer (trade name: UCAR Solution Vinyl Resin VMCH, available from Union Carbide Co., Ltd.) and 100 parts by weight of isobutyl acetate were subjected to dispersion with stainless steel beads having a diameter of 3 mm by an attritor for 100 hours. The dispersion thus obtained was applied to the above described charge-generating layer by a dip coating method, and then dried at a temperature of 115° C. for 10 minutes to form an S-character type charge-transporting layer having a thickness of 2 $\mu$m. The volume ratio of the hexagonal selenium crystal in the S-character type charge-transporting layer was about 30%. The average grain diameter of the hexagonal selenium crystal was 0.1 $\mu$m.

Subsequently, a coating solution obtained by dissolving 15 parts by weight of a compound having a viscosity average molecular weight of 120,000 and comprising a repeating unit represented by the following structural formula (3) as a charge-transporting polymer material in 85 parts by weight of monochlorobenzene was applied to the above described S-character type charge-transporting layer by a dip coating method, and then dried at a temperature of 135° C. for 1 hour to form a uniform charge-transporting layer having a thickness of 20 $\mu$m. Thus, an electrophotographic photoreceptor having the layer structure shown in FIG. 4 was prepared.

(3)

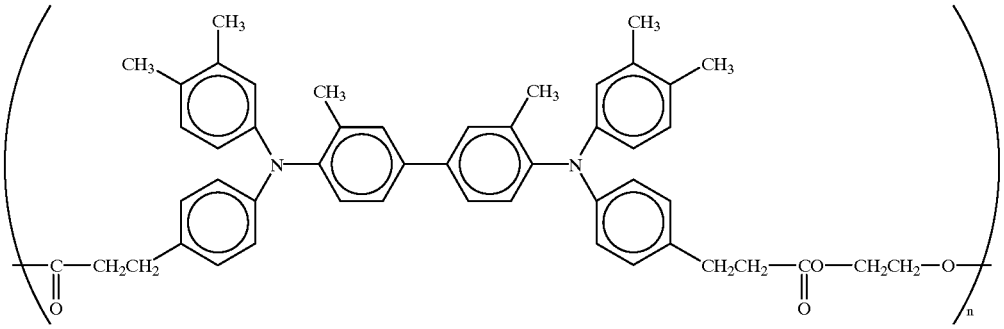

The electrophotographic photoreceptor thus obtained was then evaluated for photo-induced potential decay characteristics in the same manner as in Example 1. As a result, $E_{50\%}$ value was 0.67 $\mu J/cm^2$, and $E_{50\%}/E_{10\%}$ value was 1.7, demonstrating that the electrophotographic photoreceptor is of S-character type.

The electrophotographic photoreceptor was also measured for light transmittance and absorptance. As a result, the whole charge-transporting layer exhibited a transmittance of 72% with respect to light having a wavelength of 750 nm. The S-character type charge-transporting layer exhibited an absorptance of 11% with respect to light having a wavelength of 750 nm. The residual potential was—25 V.

EXAMPLE 6

An electrophotographic photoreceptor was prepared in the same manner as in Example 5, except that microcrystalline hydroxygallium phthalocyanine having strong diffraction peaks at least at 7.5°, 9.9°, 12.5°, 16.3°, 18.6°, 25.1° and 28.3° as Bragg angle (2θ±0.2°) in X-ray diffraction spectrum with CuKα as a radiation source was used instead of the microcrystalline chlorogallium phthalocyanine and that monochlorobenzene was used as the dispersing solvent instead of xylene and butyl acetate.

The electrophotographic photoreceptor thus obtained was then evaluated for photo-induced potential decay characteristics in the same manner as in Example 1. As a result, $E_{50\%}$ value was 0.35 $\mu J/cm^2$, and $E_{50\%}/E_{10\%}$ value was 1.7, demonstrating that the electrophotographic photoreceptor is of S-character type.

EXAMPLE 7

An electrophotographic photoreceptor was prepared in the same manner as in Example 5, except that microcrystalline 1,2-di(oxogalliumphthalocyanyl)ethane having strong diffraction peaks at least at 6.9°, 13.0°, 15.9°, 25.6° and 26.1° as Bragg angle (2θ±0.2°) in X-ray diffraction spectrum with CuKα as a radiation source was used instead of the microcrystalline chlorogallium phthalocyanine and that monochlorobenzene was used as the dispersing solvent instead of xylene and butyl acetate.

The electrophotographic photoreceptor thus obtained was then evaluated for photo-induced potential decay characteristics in the same manner as in Example 1. As a result, $E_{50\%}$ value was 0.83 $\mu J/cm^2$, and $E_{50\%}/E_{10\%}$ value was 1.9, demonstrating that the electrophotographic photoreceptor is of S-character type.

EXAMPLE 8

An electrophotographic photoreceptor was prepared in the same manner as in Example 5, except that microcrystalline α-form vanadyl phthalocyanine was used instead of the microcrystalline chlorogallium phthalocyanine and monochlorobenzene was used as the dispersing solvent instead of xylene and butyl acetate.

The electrophotographic photoreceptor thus obtained was then evaluated for photo-induced potential decay characteristics in the same manner as in Example 1. As a result, $E_{50\%}$ value was 3.9 $\mu J/cm^2$, and $E_{50\%}/E_{10\%}$ value was 2.3, demonstrating that the electrophotographic photoreceptor is of S-character type.

EXAMPLE 9

An electrophotographic photoreceptor was prepared in the same manner as in Example 5, except that microcrystalline X-form metal-free phthalocyanine was used instead of the microcrystalline chlorogallium phthalocyanine and butyl acetate alone was used as the dispersing solvent instead of xylene and butyl acetate.

The electrophotographic photoreceptor thus obtained was then evaluated for photo-induced potential decay characteristics in the same manner as in Example 1. As a result, $E_{50\%}$ value was 1.8 $\mu J/cm^2$, and $E_{50\%}/E_{10\%}$ value was 2.2, demonstrating that the electrophotographic photoreceptor is of S-character type.

EXAMPLE 10

An electrophotographic photoreceptor was prepared in the same manner as in example 5, except that microcrystalline titanyl phthalocyanine hydrate having strong diffraction peaks at least at 9.5°, 11.7°, 15.0°, 23.5° and 27.3° as Bragg angle (2θ±0.2°) in X-ray diffraction spectrum with CuKα as a radiation source was used instead of the microcrystalline chlorogallium phthalocyanine.

The electrophotographic photoreceptor thus obtained was then evaluated for photo-induced potential decay characteristics in the same manner as in Example 1. As a result, $E_{50\%}$ value was 0.42 $\mu J/cm^2$, and $E_{50\%}/E_{10\%}$ value was 1.8, demonstrating that the electrophotographic photoreceptor is of S-character type.

EXAMPLE 11

An electrophotographic photoreceptor was prepared in the same manner as in Example 5, except that a coating solution obtained by dissolving 4 parts by weight of a compound having a molecular weight of 120,000 and comprising a repeating unit represented by the following structural formula (3) in 96 parts by weight of monochlorobenzene was applied to the charge-generating layer by a dip coating method prior to the formation of the S-character type charge-transporting layer to form an interlayer having a thickness of 0.5 μm.

The electrophotographic photoreceptor thus obtained was then evaluated for photo-induced potential decay characteristics in the same manner as in Example 1. As a result, $E_{50\%}$ value was 0.64 μJ/cm$^2$, and $E_{50\%}/E_{10\%}$ value was 1.6, demonstrating that the electrophotographic photoreceptor is of S-character type. The residual potential was −11 V.

From the comparison of the results obtained in Examples 5 and 11, the effect of providing an interlayer appears. That is, residual potential was reduced by providing an interlayer. Further, better S-characteristic was attained by providing an interlayer which is sufficiently thin as compared to the total thickness of the photosensitive layer.

EXAMPLE 12

An undercoat layer and a charge-generating layer were formed on an aluminum substrate in the same manner as in Example 5.

Subsequently, 8 parts by weight of a multi-block copolymer comprising N-vinylcarbazole containing 64 mol % of N-vinylcarbazole monomer units and n-dodecyl methacrylate prepared in accordance with Example 1 of JP-A-6-83077 (corresponding to U.S. Pat. No. 5,306,586) was dissolved in a mixture of 90 parts by weight of methylene chloride and 10 parts by weight of monochlorobenzene. The solution thus obtained was applied to the above described charge-generating layer by a dip coating method, and then dried at a temperature of 115° C. for 30 minutes to form an S-character type charge-transporting layer having a thickness of 4 μm.

Subsequently, a uniform charge-transporting layer was formed on the S-character type charge-transporting layer in the same manner as in Example 5. Thus, an electrophotographic photoreceptor having a layer structure shown in FIG. 4 was prepared.

The electrophotographic photoreceptor thus obtained was then evaluated for photo-induced potential decay characteristics in the same manner as in Example 1. As a result, $E_{50\%}$ value was 3.1 μJ/cm$^2$, and $E_{50\%}/E_{10\%}$ value was 2.3, demonstrating that the electrophotographic photoreceptor is of S-character type.

The electrophotographic photoreceptor was also measured for light transmittance and absorptance. As a result, the whole charge-transporting layer exhibited a transmittance of not less than 90% with respect to light having a wavelength of 750 nm. The S-character type charge-transporting layer exhibited an absorptance of 3% with respect to light having a wavelength of 750 nm. The S-character type charge-transporting layer was observed under an electron microscope. As a result, it was confirmed that the S-character type charge-transporting layer had a microphase separation structure comprising a domain having a diameter of about 0.1 μm formed therein. From the properties of this polymer, it can be presumed that the domain in the layer is formed by N-vinylcarbazole moiety having charge-transporting ability and the matrix is formed by the electrical insulating n-dodecyl methacrylate moiety.

EXAMPLE 13

12 parts by weight of hexagonal selenium crystal was mixed with 1.8 parts by weight of a vinyl chloride-vinyl acetate copolymer (trade name: UCAR Solution Vinyl Resin VMCH, available from Union Carbide Co., Ltd.) and 100 parts by weight of isobutyl acetate. The mixture was then subjected to dispersion with stainless steel beads by means of a paint shaker for 5 hours. The coating solution thus obtained was applied to an aluminum substrate by a dip coating method, and then dried at a temperature of 100° C. for 10 minutes to form a charge-generating layer having a thickness of 0.15 μm. The content of the hexagonal selenium crystal in the charge-generating layer was about 65% by volume.

Subsequently, 3 parts by weight of microcrystalline chlorogallium phthalocyanine was mixed with 6 parts by weight of a polycarbonate resin (PC-Z, available from Mitsubishi Gas Chemical Co., Inc.; electrical resistivity: $10^{16}$ Ω·cm) and 100 parts by weight of monochlorobenzene. The mixture was then subjected to dispersion with glass beads by a paint shaking method for 2 hours. The coating solution thus obtained was applied to the above described charge-generating layer by a dip coating method, and then dried at a temperature of 100° C. for 10 minutes to form an S-character type charge-transporting layer having a thickness of 5 μm. The average grain diameter of the S-character type charge-transporting layer was 0.02 μm. Subsequently, a uniform charge-transporting layer was formed on the S-character charge-transporting layer in the same manner as in Example 1. Thus, an electrophotographic photoreceptor was prepared.

The electrophotographic photoreceptor thus obtained was then evaluated for electrophotographic properties in the same manner as in Example 1 except that the wavelength of the exposing light was changed to 500 nm. Referring to the photo-induced potential decay characteristics, E50% value was 2.2 μJ/cm$^2$, and $E_{50\%}/E_{10\%}$ value was 2.5, demonstrating that the electrophotographic photoreceptor is of S-character type.

The electrophotographic photoreceptor was also measured for light transmittance and absorptance with respect to light having a wavelength of 500 nm in the same manner as in Example 1. As a result, the whole charge-transporting layer exhibited a transmittance of not less than 55% with respect to light having a wavelength of 500 nm. The S-character type charge-transporting layer exhibited an absorptance of 28% with respect to light having a wavelength of 500 nm.

EXAMPLE 14

A coating solution obtained by dissolving 15 parts by weight of a compound comprising a repeating unit represented by the above described structural formula (2) as a charge-transporting polymer material in 85 parts by weight of monochlorobenzene was applied to an aluminum substrate by a dip coating method, and then dried at a temperature of 120° C. for 1 hour to form a uniform charge-transporting layer having a thickness of 20 μm.

Subsequently, 15 parts by weight of hexagonal selenium crystal was mixed with 8 parts by weight of a vinyl chloride-vinyl acetate copolymer (trade name: UCAR Solution Vinyl Resin VMCH, available from Union Carbide Co., Ltd.) and 100 parts by weight of isobutyl acetate. The mixture was then subjected to dispersion with stainless steel beads by a paint shaking method for 5 hours. The coating solution thus obtained was applied to the above described uniform charge-transporting layer by a dip coating method, and then dried at a temperature of 100° C. for 10 minutes to form an S-character type charge-transporting layer having a thickness of 2 μm. The selenium content of the hexagonal selenium crystal in the S-character type charge-transporting layer was about 35% by volume.

Subsequently, 2.4 parts by weight of crystalline dichlorotin phthalocyanine was mixed with 1.2 parts by weight of a polyvinyl butyral resin (trade name: S-Lec BM-S, available from Sekisui Chemical Co., Ltd.) and 100 parts by weight of n-butanol. The mixture was subjected to dispersion with glass beads by a paint shaking method for 2 hours. The dispersion thus obtained was applied to the above described S-character type charge-transporting layer by a dip coating method, and then dried at a temperature of 100° C. for 10 minutes to form a charge-generating layer having a thickness of 0.2 $\mu$m. Thus, an electrophotographic photoreceptor having a layer structure shown in FIG. 6 was prepared.

The electrophotographic photoreceptor thus obtained was then evaluated for electrophotographic properties in the same manner as in Example 1 except that the charging polarity was positive. Referring to the photo-induced potential decay characteristics, $E_{50\%}$ value was 2.9 $\mu$J/cm$^2$, and $E_{50\%}/E_{10\%}$ value was 2.3, demonstrating that the electrophotographic photoreceptor is of S-character type.

COMPARATIVE EXAMPLE 3

An electrophotographic photoreceptor was prepared in the same manner as in Example 6, except that the S-character type charge-transporting layer was not applied. The electrophotographic photoreceptor thus obtained was then evaluated for electrophotographic properties in the same manner as in Example 1. As a result, a photo-induced potential decay curve as shown in FIG. 1, which is not of S-character type, was obtained. From this photo-induced potential decay curve, $E_{50\%}/E_{10\%}$ value was calculated as 5.3.

EXAMPLE 15

A coating solution obtained by dissolving 8 parts by weight of N,N'-diphenyl-N,N'-bis(3-methylphenyl) benzidine as a low molecular weight charge-transporting material and 12 parts by weight of a polycarbonate resin (PC-Z, available from Mitsubishi Gas Chemical Co., Inc.) in 100 parts by weight of monochlorobenzene was applied to an aluminum substrate by a dip coating method, and then dried at a temperature of 120° C. for 1 hour to form a uniform charge-transporting layer having a thickness of 20 $\mu$m.

An S-character type charge-transporting layer and a charge-generating layer were sequentially formed on the uniform charge-transporting layer in the same manner as in Example 14 to prepare an electrophotographic photoreceptor.

The electrophotographic photoreceptor thus obtained was then evaluated for electrophotographic properties in the same manner as in Example 1. Referring to its photo-induced potential decay characteristics, $E_{50\%}$ value was 4.3 $\mu$J/cm$^2$, and $E_{50\%}/E_{10\%}$ value was 2.8, demonstrating that the electrophotographic photoreceptor is of S-character type.

Isobutyl acetate, which was used in the application of the S-character type charge-transporting layer, is a solvent which can hardly dissolve therein the resin and the low molecular weight charge-transporting material used in the uniform charge-transporting layer. Therefore, it can be presumed that the S-character type charge-transporting layer is little or not contaminated by the low molecular weight charge-transporting material, making it possible to give a good photosensitivity as well as S-characteristic.

Thus, with such an arrangement and/or a combination that a low molecular weight charge-transporting material can hardly contaminate the S-character type charge-transporting layer, a low molecular weight charge-transporting material can be used in the uniform charge-transporting layer if materials and/or preparation process are selected appropriately.

EXAMPLE 16

Figure 10:
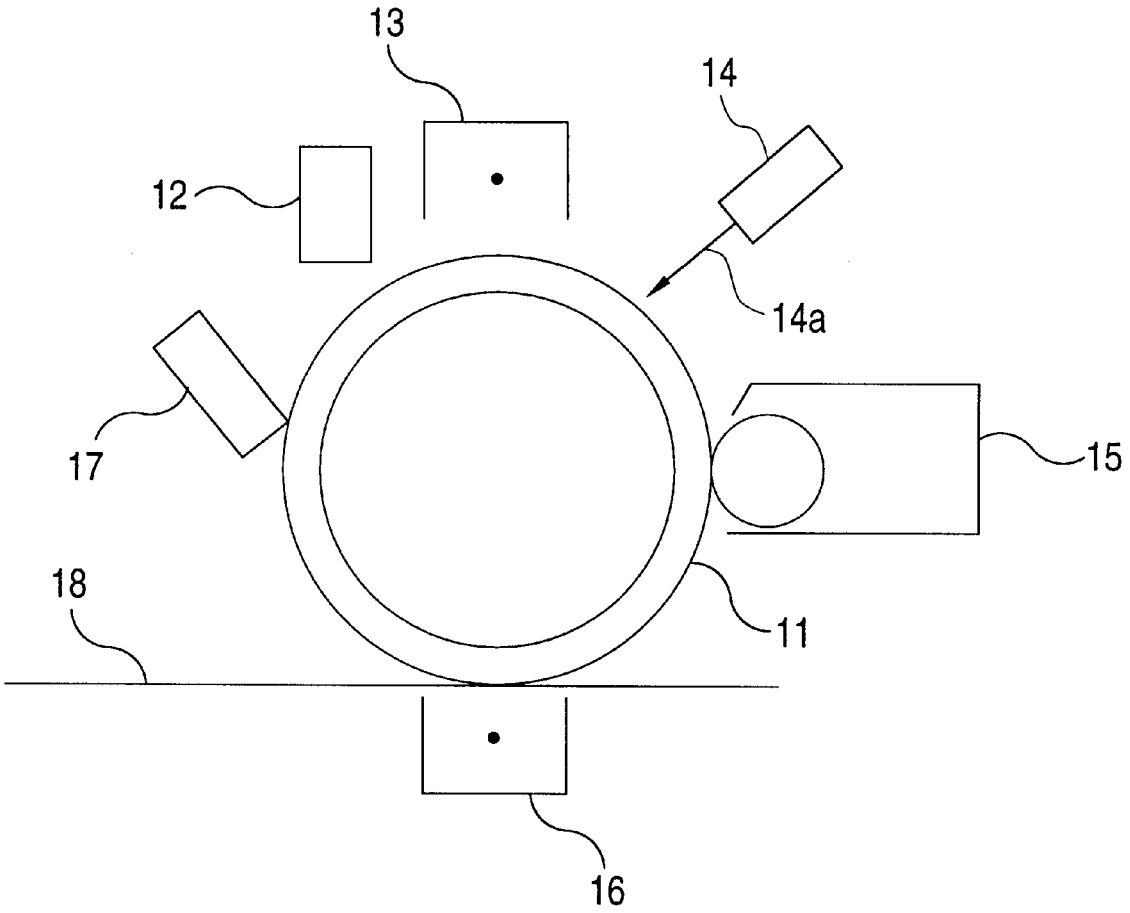
FIG. 10 is a schematic diagram illustrating the constitution of the electrophotographic apparatus according to the present invention used in the examples in which an exposure is carried out in accordance with digitized image signals.

An electrophotographic photoreceptor was prepared in the same manner as in Example 1, except that an aluminum drum was used instead of the aluminum substrate. The electrophotographic photoreceptor thus obtained was then mounted on a laser printer (Laser Press 4105, available from Fuji Xerox Co., Ltd.). A printing test was then conducted. In order to provide an optimum exposure amount, an ND filter was disposed in the passage of the laser light. FIG. 10 illustrates a schematic diagram of the laser printer.

Provided on the periphery of a photoreceptor drum 11 are a pre-exposing light source (red LED) 12, a charging scorotron 13, an exposing laser optical system 14, a developing apparatus 15, a transferring corotron 16 and a cleaning blade 17 in the processing order. The exposing laser optical system 14 is equipped with an exposing laser diode having an emission wavelength of 780 nm. The laser diode emits light in response to digitized image signals. Laser beam 14*a* thus emitted is utilized to expose the photoreceptor surface while being scanned by a polygon mirror and a plurality of lens and mirrors. Shown at the reference numeral 18 is paper.

COMPARATIVE EXAMPLE 4

An electrophotographic photoreceptor was prepared in the same manner as in comparative Example 1, except that an aluminum drum was used instead of the aluminum substrate. The electrophotographic photoreceptor thus prepared was then subjected to printing test in the same manner as in Example 16.

The comparison of print quality between Example 16 and comparative Example 4 showed that Example 16 exhibits an excellent print quality in terms of the reproduction of fine lines, as compared to that of comparative Example 4.

The electrophotographic photoreceptor according to the present invention has a novel photoreceptor constitution which exhibits an S-character type photo-induced potential decay characteristics. In particular, the electrophotographic photoreceptor according to the present invention can employ the above described function-separation laminated constitution to allow the use of the conventional materials for J-character type photoreceptor. This allows extended degree of freedom in selecting materials. Because of the advantage, the electrophotographic photoreceptor according to the present invention exhibits excellent electrophotographic properties such as photosensitivity and high-speed response.

Further, the electrophotographic apparatus employing the S-character type electrophotographic photoreceptor according to the present invention provides a printed image excellent in print quality and image quality when operated with a process in which exposure is carried out in response to digitized image signals.

While the invention has been described in detail and with reference to specific examples thereof, it will be apparent to one skilled in the art that various changes and modifications can be made therein without departing from the spirit and scope thereof.

What is claimed is:

1. An electrophotographic apparatus, comprising:

(a) an electrophotographic photoreceptor comprising an electrically conductive substrate having thereon a charge-generating layer and a charge-transporting layer wherein said charge-transporting layer comprises: a nonuniform charge-transporting layer comprising an electrically inactive matrix and a charge-transporting domain dispersed in said matrix; and a uniform charge-transporting layer comprising a charge-transporting matrix;

(b) exposing means for exposing the electrophotographic photoreceptor in accordance with a digitized image signal;

wherein the charge-transporting domain in the nonuniform charge-transporting layer has an average grain diameter of from 0.005 to 0.5 $\mu$m.

2. The electrophotographic apparatus according to claim 1, wherein the exposure amount of said photoreceptor required for 50% potential decay is less than 5 times that required for 10% potential decay.

3. The electrophotographic apparatus according to claim 1, wherein the exposure amount of the photoreceptor required for 50% potential decay is less than 3 times that required for 10% potential decay.

4. The electrophotographic according to claim 1, wherein said charge-generating layer and said nonuniform charge-transporting layer are adjacent to each other.

5. The electrophotographic apparatus according to claim 1, wherein said uniform charge-transporting layer, said nonuniform charge-transporting layer and said charge-generating layer are laminated on said electrically conductive substrate in this order.

6. The electrophotographic apparatus according to claim 1, wherein said charge-generating layer, said nonuniform charge-transporting layer and said uniform charge-transporting layer are laminated on said electrically conductive substrate in this order.

7. The electrophotographic apparatus according to claim 1, wherein said uniform charge-transporting layer comprises a charge-transporting polymer.

8. The electrophotographic apparatus according to claim 7, wherein said charge-transporting polymer comprises at least one structure represented by the following general formula (1) as a repeating unit:

(1)

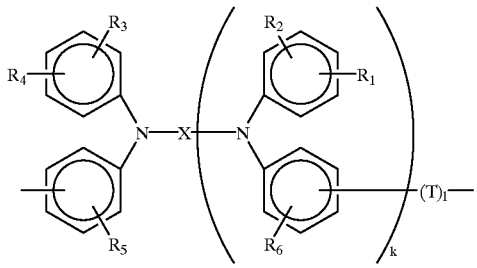

wherein $R_1$ to $R_6$ each independently represent a hydrogen atom, an alkyl group, an alkoxy group, a substituted amino group, a halogen atom or a substituted or unsubstituted aryl group; X represents a divalent hydrocarbon or hetero atom-containing divalent hydrocarbon group containing a substituted or unsubstituted aromatic group; T represents a divalent hydrocarbon or hetero atom-containing divalent hydrocarbon group having from 1 to 20 carbon atoms and containing or not containing a branched-structure and a ring-structure; and k and l each represent an integer of 0 or 1.

9. The electrophotographic apparatus according to claim 7, wherein the content of a charge-transporting compound having a molecular weight of not more than 1,000 in said uniform charge-transporting layer is less than 5% by weight.

10. The electrophotographic apparatus according to claim 1, wherein said nonuniform charge-transporting layer comprises a binder resin having an electrical resistivity of not less than $10^{13}$ $\Omega\cdot$cm and a fine particulate charge-transporting material having an average grain diameter of not more than 0.5 $\mu$m dispersed in said binder resin in a volume proportion of from 20 to 40%.

11. The electrophotographic apparatus according to claim 10, wherein said fine particulate charge-transporting material comprises hexagonal selenium.

12. The electrophotographic apparatus according to claim 1, wherein said nonuniform charge-transporting layer comprises a block or graft copolymer comprising a charge-transporting block and an insulating block, and said block or graft copolymer has undergone microphase separation to have a sea-island structure having a sea portion formed by said insulating block and island portions formed by said charge-transporting block.

13. The electrophotographic apparatus according to claim 1, wherein said charge-generating layer comprises a phthalocyanine compound as a charge-generating material.

14. The electrophotographic apparatus according to claim 13, wherein said phthalocyanine compound is selected from the group consisting of dichlorotin phthalocyanine, titanyl phthalocyanine, chlorogallium phthalocyanine, hydroxygallium phthalocyanine, 1,2-di(oxogallium phthalocyanyl) ethane, metal-free phthalocyanine and vanadyl phthalocyanine.

15. The electrophotographic apparatus according to claim 13, wherein said phthalocyanine compound is dichlorotin phthalocyanine, and said charge-transporting layer is hole-transporting, said charge-generating layer and said hole charge-transporting layer are laminated on said electrically conductive substrate in this order.

16. The electrophotographic apparatus according to claim 1, wherein said charge-generating layer comprises hexagonal selenium as a charge-generating material.

17. The electrophotographic apparatus according to claim 1, wherein said electrophotographic photoreceptor further comprises an interlayer interposed between said charge-generating layer and said nonuniform charge-transporting layer, said interlayer comprising a second charge-transporting matrix.

18. The electrophotographic apparatus according to claim 1, wherein said charge-transporting domains in said nonuniform charge-transporting layer contact with each other to form a contorted charge-transporting passage.

19. The electrophotographic apparatus according to claim 1, wherein said nonuniform charge-transporting layer is provided closer to said exposing means than said charge-generating layer and said nonuniform charge-transporting layer has an absorptance of not more than 30% to exposing light from said exposing means.

20. The electrophotographic apparatus according to claim 1, wherein said nonuniform charge-transporting layer is provided closer to said exposing means than said charge-generating layer and said charge-transporting layer has a transmission of not less than 50% to exposing light from said exposing means.

21. The electrophotographic apparatus according to claim 1, wherein said electrophotographic photoreceptor further comprises an undercoat layer and an interlayer, wherein said undercoat layer said charge-generating layer, said interlayer, said nonuniform charge-transporting layer and said uniform charge-transporting layer are laminated in this order either from a support side or an uppermost layer side.

22. The electrophotographic apparatus according to claim 1, wherein said exposing means emits light at a wavelength of from 600 to 850 nm.

* * * * *